US010253482B2

(12) United States Patent
Funabiki et al.

(10) Patent No.: US 10,253,482 B2
(45) Date of Patent: Apr. 9, 2019

(54) CONTROL VALVE DIAGNOSTIC SYSTEM IN HYDRAULIC CIRCUIT

(71) Applicant: Caterpillar SARL, Geneva (CH)

(72) Inventors: Naoto Funabiki, Tokyo (JP); Matthew James Beschorner, Plainfield, IL (US)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/514,224

(22) PCT Filed: Sep. 24, 2015

(86) PCT No.: PCT/EP2015/071969
§ 371 (c)(1),
(2) Date: Mar. 24, 2017

(87) PCT Pub. No.: WO2016/046314
PCT Pub. Date: Mar. 31, 2016

(65) Prior Publication Data

US 2017/0275853 A1 Sep. 28, 2017

(30) Foreign Application Priority Data

Sep. 24, 2014 (JP) ..... 2014-193392
Jun. 25, 2015 (JP) ..... 2015-127634

(51) Int. Cl.
*E02F 9/26* (2006.01)
*E02F 9/22* (2006.01)
*F15B 19/00* (2006.01)

(52) U.S. Cl.
CPC ..... *E02F 9/267* (2013.01); *E02F 9/226* (2013.01); *E02F 9/2292* (2013.01); *E02F 9/2296* (2013.01); *F15B 19/005* (2013.01)

(58) Field of Classification Search
CPC ..... E02F 9/2292; E02F 9/2296; E02F 9/226; E02F 9/267; F15B 19/005
See application file for complete search history.

(56) References Cited

U.S. PATENT DOCUMENTS 5,947,140 A 9/1999 Aardema et al.
6,055,851 A * 5/2000 Tanaka ..... E02F 9/2235 73/40
2011/0137515 A1 6/2011 Steinborn et al.
2011/0208362 A1* 8/2011 Alstrin ..... F15B 21/08 700/282

FOREIGN PATENT DOCUMENTS

EP 2435886 A1 4/2012
EP 2650548 A2 10/2013
GB 2171778 A 9/1986
JP H7286603 9/1985
JP 2012528364 11/2012
JP 2012241426 12/2012

* cited by examiner

*Primary Examiner* — Mussa A Shaawat

(57) ABSTRACT

This invention provides to set plural test patterns in which two or more control valves are picked up from the plural control valves as diagnosis target, and there being installed a malfunction diagnosis means (47) in which the diagnosis of malfunctioned valve is applied to the test patterns as unit, and malfunction valve identification means (48) in which the malfunctioned valves are identified by checking the control valves one another, that control valves are included in the test patterns having been diagnosed whether malfunction exists or not by the malfunction diagnosis means (47).

6 Claims, 13 Drawing Sheets

| | | Test patterns | | | | Pump tests | |
|---|---|---|---|---|---|---|---|
| | | 1 | 2 | 3 | 4 | 1 | 2 |
| Diagnosis target valves | 25: first bypass valve | ○ | | ○ | | | |
| | 26: second bypass valve | | ○ | | ○ | | |
| | 21: first main relief valve | ○ | | ○ | | | |
| | 22: second main relief valve | | ○ | | ○ | | |
| | 32: first warm up valve | ○ | | ○ | ○ | | |
| | 33: second warm up valve | | ○ | ○ | ○ | | |
| | 27: straight travel valve | | | | | | |
| | 29: merge valve | | | | | | |
| | 1: first hydraulic pump | | | | | ○ | |
| | 2: second hydraulic pmp | | | | | | ○ |

Fig. 3

| | | Test patterns | | | | Pump tests | |
|---|---|---|---|---|---|---|---|
| | | 1 | 2 | 3 | 4 | 1 | 2 |
| Diagnosis target valves | 25: first bypass valve | ○ | | ○ | | | |
| | 26: second bypass valve | | ○ | | ○ | | |
| | 21: first main relief valve | ○ | | ○ | | | |
| | 22: second main relief valve | | ○ | | ○ | | |
| | 32: first warm up valve | ○ | | ○ | ○ | | |
| | 33: second warm up valve | | ○ | ○ | ○ | | |
| | 27: straight travel valve | | | | | | |
| | 29: merge valve | | | | | | |
| | 1: first hydraulic pump | | | | | ○ | |
| | 2: second hydraulic pmp | | | | | | ○ |

CONTROL VALVE DIAGNOSTIC SYSTEM IN HYDRAULIC CIRCUIT

CROSS-REFERENCE TO RELATED APPLICATIONS

This application is a national phase application of International Patent Application No. PCT/EP2015/071969 filed Sep. 24, 2015, which claims priority to Japanese Patent Application No. 2014-193392 filed Sep. 24, 2014 and Japanese Patent Application No. 2015-127634 filed Jun. 25, 2015, each of which are incorporated by reference herein in their entireties for all purposes.

TECHNICAL FIELD

The present invention relates to a technical field of control valve diagnostic system for hydraulic circuit of working machines, such as a construction machine.

BACKGROUND ART

In general, in a hydraulic circuit of a working machine such as a construction machine, have various control valves to control actuations of various hydraulic actuators, such as hydraulic cylinders or hydraulic travel motors, and those control valves requires urgent maintenance actions such as repair or replacement, in case a failure has occurred. However, for example, in case a problem such as output shortage of a hydraulic actuator, insufficient hydraulic line pressure, or unstable pump pressure, has occurred to the hydraulic circuit, it may take a significant amount of time to determine which control valve component has caused the issue because there are multiple components to the control valve which can be the cause of the problem. Many troubleshooting and test operations may be required to resolve the hydraulic circuit problem which is typically resolved by replacing the control valve component which caused the problem. In particular, for construction machines, there has been known a control valve system with four of independent metering valves to control hydraulic oil flow from/to a hydraulic actuator, which has the first and the second meter-in valves that control hydraulic oil flow to a pair of the hydraulic actuator ports and the first and the second meter-out valves that control hydraulic oil flow from the pair of the hydraulic actuator ports, for the purpose of fine and efficient hydraulic actuator control with independent electronic control of each metering valve (see Patent Document 1, for example). Such a hydraulic circuit with independent metering valves has a complicated configuration because there are not only four metering valves per one hydraulic actuator, but more valves such as a combiner valve to combine multiple pump flows or relief valves to control pump pressure, which are for purposes outside of hydraulic actuator control. Therefore in case a problem occurred to the hydraulic circuit, it takes lots of time and requires higher level understanding of the hydraulic circuit configuration for a service engineer to determine the failed control valve component among lots of control valve components which can cause the problem.

On the other hand, as a control valve fault diagnostic system for hydraulic circuit of working machines, there has been known technology for a control device to output control signals to control valves, which has interchangeable 2 control modes, the first one is normal control mode for normal control procedures and the other one is fault diagnostic mode for particular fault diagnostic procedures. And in the fault diagnostic mode, a control valve fault is detected based on the hydraulic pump discharge pressure during the fault diagnostic procedure is applied to the control valve. (see Patent Document 2, for example).

Patent Document 1: Japanese Patent Application Laid-open No. 10-311301

Patent Document 2: Japanese Patent Application Laid-open No. 2000-46015

DISCLOSURE OF THE INVENTION

However, the fault diagnostic system in Patent Document 2, the system specifies a control valve which is diagnosed and each of control valves is diagnosed individually. This fault diagnostic system still takes a lot of time for fault diagnosis because in the case of multiple control valve components that may have possibility to be cause of a hydraulic circuit problem, the fault diagnostic procedure should be done for all of those control valve components one by one. Further, there is a possibility that a control valve component failure can effect the fault diagnosis result of another control valve component in normal work so that correct fault diagnosis results may be unavailable with the fault diagnostic system. Those problems will be resolved by the present invention.

The present invention has been made in view of the above and to resolve the problems. The invention described in claim 1 is a control valve fault diagnostic system in a hydraulic circuit. A hydraulic circuit of a construction machine includes hydraulic pumps, hydraulic actuators which are actuated by hydraulic oil delivered from the hydraulic pump, and multiple control valve components which control flow direction, volume and pressure of hydraulic oil delivered from the hydraulic pump. The control valve fault diagnostic system to diagnose the control valve components includes multiple test patterns which have various combinations that target 2 or more control valve components out of the control valve assembly, a fault diagnostic execution method which outputs control signals for each of the test patterns to control valve components to carry out fault diagnosis operation, and a fault control valve determination method which specifies fault control valves by checking the control valve components which are included in the test patterns diagnosed by the fault diagnostic execution method.

The invention described in claim 2 is a control valve fault diagnostic system in a hydraulic circuit described in claim 1. The fault diagnostic execution method carries out multiple test patterns to determine fault control valves in order. And also, after each of the test pattern is completed, the fault diagnostic method terminates the execution of the rest test patterns if the fault diagnostic method can determine fault control valves based on diagnosis result of completed test patterns, and the fault diagnostic method continues the rest test patterns if the fault diagnostic method cannot determine fault control valves.

The invention described in claim 3 is a control valve fault diagnostic system in a hydraulic circuit described in claim 1. The fault control valve determination method specifies fault control valves after all of test patterns to determine fault control valves are carried out by the fault diagnostic execution method, based on the diagnosis results of all test patterns.

The invention described in claim 4 is a control valve fault diagnostic system in a hydraulic circuit described in one of claim 1, claim 2 or claim 3. The fault diagnostic execution method and the fault control valve determination method are connected to the monitor device which is located in a construction machine cab, and the fault diagnosis of the test patterns and determination of fault control valves are carried out by the operation of the monitor device, and also the diagnosis result is displayed on the monitor device.

The invention described in claim 5 is a control valve fault diagnostic system in a hydraulic circuit described in one of claim 1, claim 2, claim 3 or claim 4. The hydraulic actuator has a pair of hydraulic ports for the hydraulic oil inlet and outlet for its actuation. And the metering valve components used to control hydraulic oil flow from/to the hydraulic actuators include the first electronically controlled meter-in valve to control supply oil flow to a hydraulic actuator port, the first electronically controlled meter-out valve to control disposing oil flow from a hydraulic actuator port, the second electronically controlled meter-in valve to control supply oil flow to the other hydraulic actuator port, and the second electronically controlled meter-out valve to control disposing oil flow from the other hydraulic actuator port.

According to the invention described in claim 1, the fault control valve determination method can determine fault control valves based on the diagnosis results of test patterns which are carried out by the fault diagnostic execution method. As the result, the control valve fault diagnosis time can be considerably shortened without higher level understanding of the hydraulic circuit configuration, and furthermore, the control valves maintainability and serviceability can be greatly improved.

According to the invention described in claim 2, the fault diagnostic method terminates the execution of the rest test patterns if the fault diagnostic method can determine fault control valves, even if there are lots of test patterns to diagnose lots of control valve components, therefore the control valve fault diagnosis can be carried out in shorter time.

According to the invention described in claim 3, the fault diagnosis control program can be more simple and easier to be updated such as to add new test patterns.

According to the invention described in claim 4, the control valve fault diagnosis can be carried out with the monitor device located in a cab, without any additional operation device or monitor device for fault diagnosis.

According to the invention described in claim 5, the control valve fault diagnosis system can be applicable for a complicated hydraulic circuit comprising individual 4 metering valves of the first and the second meter-in valves and the first and the second meter-out valves.

BRIEF DESCRIPTION OF THE DRAWINGS

FIG. 3 is a chart showing the control valve components diagnosed in each test pattern and a pump test.

BEST MODE FOR CARRYING OUT THE INVENTION

Figure 1:
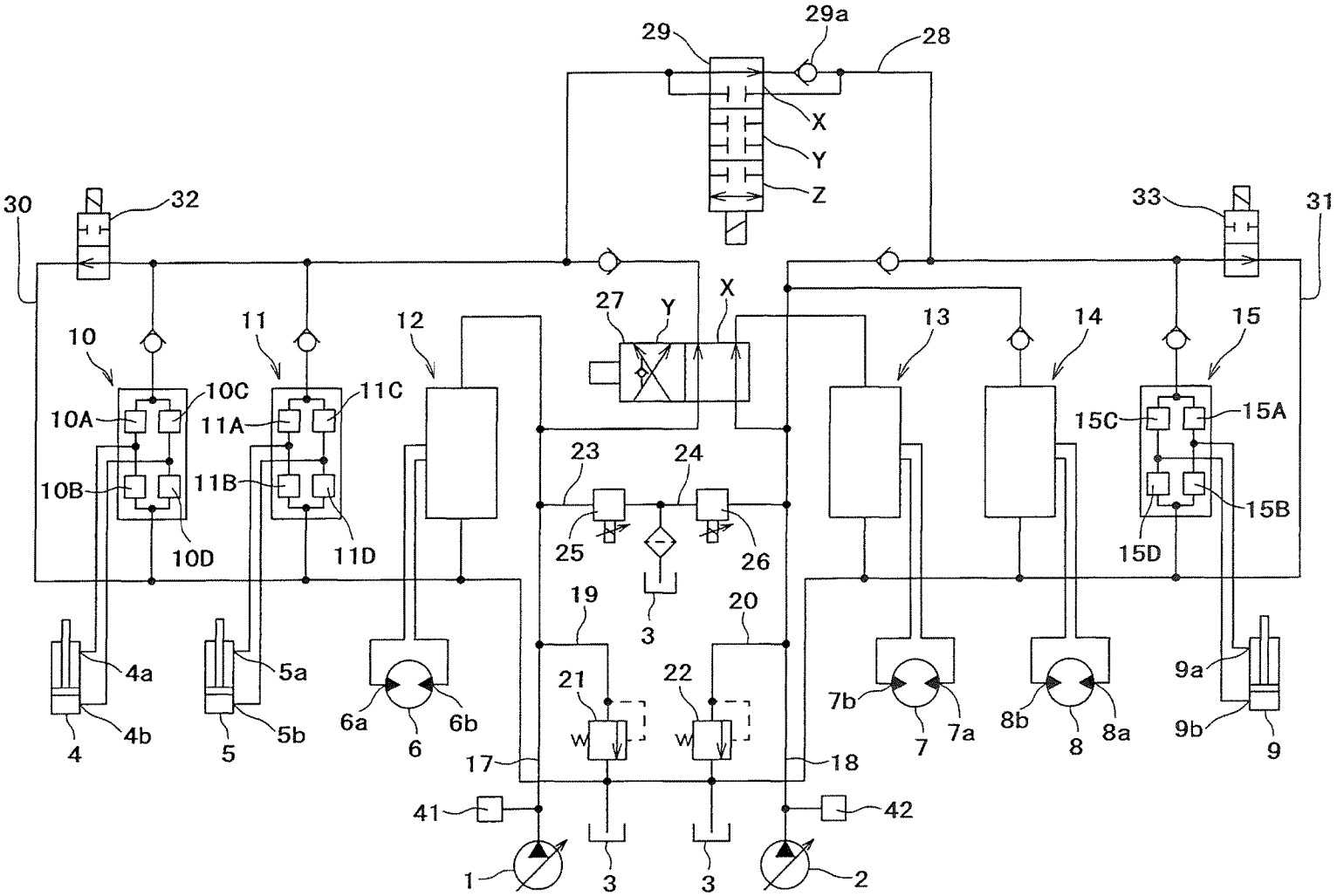
FIG. 1 is a hydraulic circuit diagram of the hydraulic excavator.

A first embodiment of the present invention is explained below with reference to the drawings. FIG. 1 shows a hydraulic circuit diagram of a hydraulic excavator (one example of a construction machine in this invention) with the fault diagnostic system disclosed in this invention. In the hydraulic circuit, reference numeral 1 and 2 denote the first and the second variable displacement hydraulic pumps (in this embodiment, the variable displacement hydraulic pump is a piston pump with a swash plate which can change its displacement according to the angle of the swash plate.), reference numeral number 3 denotes a hydraulic tank, reference numeral number 4 to 9 are hydraulic actuators which are actuated by hydraulic oil discharged from the first and the second hydraulic pump 1 and 2. And in this embodiment, there are a bucket cylinder 4, a boom cylinder 5 and a left travel motor 6, as hydraulic actuators which are mainly actuated by pressurized oil from the first hydraulic pump 1, and there are a right travel motor 7, a swing motor 8 and a stick cylinder 9, as hydraulic actuators which are mainly actuated by pressurized oil from the second hydraulic pump 2.

Additionally, reference numeral number 10, 11 and 15 denote metering valve units for the bucket, boom and stick, respectively, which control hydraulic oil flow from/to the bucket cylinder 4, the boom cylinder 5 and the stick cylinder 9, and each of those metering valve unit 10, 11 and 15 includes 4 of independent electronic control type valves. Detail valve configuration is explained with the bucket metering valve unit 10, as an example. The bucket metering valve unit 10 includes the first meter-in valve 10A which controls supply oil flow to the rod end cylinder port 4*a* for hydraulic oil inlet/outlet of the rod end oil chamber of the bucket cylinder 4, the first meter-out valve 10B which controls disposing oil flow from the rod end cylinder port 4*a*, the second meter-in valve 10C which controls supply oil flow to the head end cylinder port 4*b* for the hydraulic oil inlet/outlet of the head end oil chamber of the bucket cylinder 4, and the second meter-out valve 10D which controls disposing oil flow from the head end cylinder port 4*b*. And also, displacement of the first and the second meter-in valve 10A and 10C, and the first and the second meter-out valve 10B and 10D are controlled by control signals from the controller 16 described later. In this embodiment, the rod end cylinder port 4*a* and the head end cylinder port 4*b* correspond to the pair of hydraulic actuator ports of metering valve unit 10, and also, the boom cylinder 5 and stick cylinder 9 have a pair of the hydraulic actuator ports 5*a*, 5*b*, 9*a* and 9*b*, for inlet/outlet of the hydraulic oil. Though detail explanation for the boom and stick metering valve units 11 and 15 are omitted here, those boom and stick metering valve units 11 and 15 include the first and the second electronic control type meter-in valve 11A, 11C, 15A and 15C, and the first and the second electronic control type meter-out valve 11B, 11D, 15B and 15D, which are controlled by signals from controller 16, and is same as the bucket metering valve unit 10.

Furthermore, reference numeral numbers 12 and 13 denote the metering valve units for the left and the right travel motors, which control hydraulic oil flow from/to the left and right travel motor 6 and 7. The metering valve unit 12 and 13 include hydraulic pilot control type valves which are controlled by hydraulic pilot pressure from pilot valves (not illustrated), according to operations of travel control levers. And reference number 14 denotes the metering valve unit for swing motor 8. Metering valve unit 14 includes electronic control type valves without independent meter-in and meter-out control.

Furthermore, reference numbers 17 and 18 denote the first and the second delivery lines which are connected to outlet ports of the first and the second hydraulic pump 1 and 2. Pressurized hydraulic oil in the first delivery line 17 is supplied to the left travel motor metering valve unit 12, and also supplied to the bucket metering valve unit 10 and the boom metering valve unit 11 through the first position X of the straight travel valve 27, which is described later. On the other hand, pressurized hydraulic oil in the first delivery line 18 is supplied to the swing metering valve unit 14 and the stick metering valve unit 15, and also supplied to the right travel motor metering valve unit 13 through the first position X of the straight travel valve 27.

Furthermore, reference numbers 19 and 20 denote the first and the second relief lines which are branch lines of the first and the second delivery line 17 and 18 and connected to the hydraulic tank 3. The first and the second relief line 19 and 20 includes the first and the second main relief valve 21 and 22, to set the maximum hydraulic pressure value in the first and the second delivery line 17 and 18.

Furthermore, reference numbers 23 and 24 denotes the first and the second bypass lines which are branch lines of the first and the second delivery line 17 and 18 at the downstream of the first and the second relief line 19 and 20, and connected to the hydraulic tank 3. The first and the second bypass line 23 and 24 include the first and the second bypass valve 25 and 26 to control hydraulic oil flow in the first and the second bypass line 23 and 24, which are controlled by control signals from the controller 16.

Furthermore, the straight travel valve 27 is a two position switching valve which may be proportional and can switch the delivery lines to the first position X or the second position Y. When the straight travel valve 27 is located in the first position X, pressurized hydraulic oil in the first delivery line 17 is supplied to the left travel motor metering valve unit 12 and pressurized hydraulic oil in the second delivery line 18 is supplied to the right travel motor metering valve unit 13. On the other hand, when the straight travel valve 27 is located in the second position Y, pressurized hydraulic oil in the first delivery line 17 is supplied to both the left and the right travel motor metering valve units 12 and 13. Additionally, when the straight travel valve 27 is located in the second position Y, pressurized hydraulic oil in the second delivery line 18 is supplied to the bucket metering valve unit 10, the boom metering valve unit 11, the swing motor metering valve unit 14, and the stick metering valve unit 15.

Furthermore, reference number 28 denotes a merge circuit which is connected between the first delivery line 17 and the second delivery line 18. The merge circuit 28 includes a merge valve 29 which is switched by control signals from the controller 16. The merge valve 29 is a three position switching valve that may be proportional with a check valve 29*a*. When the merge valve 29 is located in the first position X, the check valve 29*a* allows hydraulic oil flow from the first delivery line 17 to the second delivery line 18 but does not allow oil from the second delivery line 18 to the first delivery line 17. When the merge valve 29 is located in the second position Y, hydraulic oil flow between the first delivery line 17 and the second delivery line 18 is not allowed. And when the merge valve 29 is located in the third position Z, the first delivery line 17 and the second delivery line 18 are connected and hydraulic oil flow from each delivery line can be merged.

Furthermore, reference numbers 30 and 31 denote the first and the second tank return lines which return hydraulic oil from the first and second delivery lines 17 and 18 to hydraulic oil tank 3. The first and the second return lines 30 and 31 include the first and second warm up valves 32 and 33 to block flow to the first and the second return lines 30 and 31, which are controlled by signals from controller 16.

In this embodiment, the first and the second main relief valves 21 and 22, the first and the second bypass valves 25 and 26, the straight travel valve 27, the merge valve 29 and the first and the second warm up valves 32 and 33 correspond to the control valves of this invention. And these control valve components and the metering valve units 10, 11, 12, 13, 14 and 15 comprise one control valve unit assembly.

Figure 2:
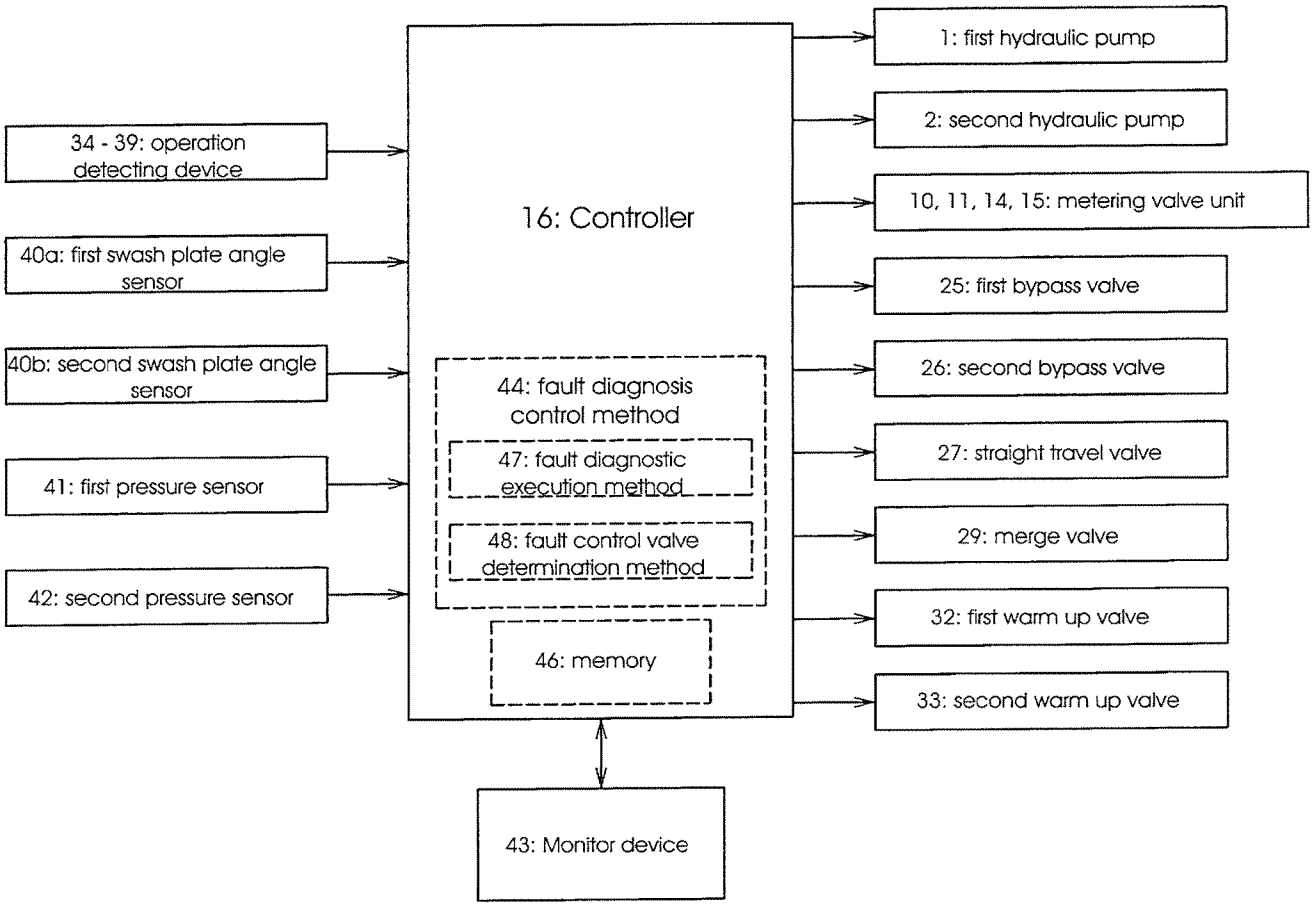
FIG. 2 is a block diagram showing inputs and outputs of the controller.

The controller 16 comprises a microcomputer. As shown in the block diagram of FIG. 2, The controller 16 has input signals from devices such as the operation detection device 34, 35, 36, 37, 38 and 39 which can detect operation direction and operation angles of control devices for hydraulic actuators (such as control levers or pedals, for operation of the bucket, boom, left and right travel, swing and stick, not illustrated.), the first and the second swash plate angle sensors 40*a* and 40*b* which can detect swash plate angle of the first and the second hydraulic pumps 1 and 2, the first and the second pressure sensor 41 and 42 which can detect the hydraulic pressures of the first and second delivery lines 17 and 18, and the monitor device 43, which is described later.

According to the input signals, the controller 16 outputs control signals to hydraulic system components, such as the first and the second hydraulic pumps 1 and 2, the bucket, boom, swing and stick metering valve units 10, 11, 14 and 15, the first and second bypass valves 25 and 26, the straight travel valve 27, the merge valve 29, the first and the second warm up valves 32 and 33, and the monitor device 43. And also, the controller 16 includes the fault diagnosis control method 44 and memory 46. And the controller 16 carries out controls such as normal control to actuate the hydraulic actuators 4, 5, 6, 7, 8 and 9 according to operation of control devices for hydraulic actuators, warm up control to warm up hydraulic circuit according to operation of the monitor device 43, and fault diagnosis control to diagnose control valves with the fault diagnosis control method 44. In this embodiment, the monitor device 43 is located in the operator cab, includes a monitor display and operation keys, and connected to the controller 16 (not illustrated).

First details of the normal control with the controller 16 are explained. When the controller 16 is inputted hydraulic actuator control signals from the bucket, boom, swing and stick operation detection device 34, 35, 38 and 39, the controller 16 outputs control signals to the operated hydraulic actuator metering valve units 10, 11, 14 and 15, to control hydraulic oil flow volume from/to the corresponded hydraulic actuators (the bucket cylinder 4, the boom cylinder 5, the swing motor 8 and the stick cylinder 9). For example, when a control signal for bucket out (contraction of the bucket cylinder 4) is inputted to the controller 16, the controller 16 outputs a control signal to the first meter-in valve 10A and the second meter-out valve 10D in the bucket metering valve unit 10 to control hydraulic oil flow to the rod end cylinder port 4*a* of the bucket cylinder 4 and hydraulic oil flow from the head end cylinder port 4*b* of the bucket cylinder 4.

Furthermore, in the normal control, when controller 16 receives hydraulic actuator input control signals, controller 16 outputs control signals for valve opening area control to the first and the second bypass valves 25 and 26 for hydraulic oil flow control in the first and the second bypass lines 23 and 24 to control delivery pressure of the first and the second hydraulic pumps 1 and 2 for the operated-hydraulic actuators, according to the operation angle of the control devices. The memory 46 in controller 16 includes map data which shows relationship between operation angles of the hydraulic actuator control devices and opening areas of the first and the second bypass valves 25 and 26, to control opening areas of the first and the second bypass valves 25 and 26 with the map data. When the hydraulic actuator control devices are in the neutral position, the first and the second bypass valves 25 and 26 are controlled to open the first and the second bypass lines 23 and 24 with maximum valve opening area and so the first and the second hydraulic pumps 1 and have a low delivery pressure.

Furthermore in normal control, when both left and right travel control devices are operated for straight travel and additionally one of the control devices for the bucket, boom, swing and stick is operated, the controller 16 outputs a control signal to the straight travel valve 27 to switch to the second position Y. In this position, hydraulic oil flow from the first hydraulic pump 1 is supplied to the left travel motor 6 and the right travel motor 7, and hydraulic oil flow from the second hydraulic pump 2 is supplied to one of the actuator, the bucket cylinder 4, the boom cylinder 5, the swing motor 8 or the stick cylinder 9, according to the operated control device. Then hydraulic oil flow from the first hydraulic pump 1 can be supplied only to the left and right travel motor 6 and 7 and also be equivalently distributed among the motors 6 and 7. In case only one of the left or right travel control device is operated, or, in case only the control device for the bucket, boom, swing and stick are operated, then the straight travel valve 27 is switched to the first position X.

Furthermore in the normal control, when an operation signal for a hydraulic actuator, which requires relatively larger oil flow volume (such as the boom cylinder 5 or the stick cylinder 9), is inputted, controller 16 outputs a control signal to merge valve 29 to supply merged hydraulic oil from the first hydraulic pump 1 and the second hydraulic pump 2 to the operated actuator. And then controller 16 calculates required hydraulic oil flow according to the hydraulic actuator control device operation angle, and controls the total merged hydraulic oil flow with the required hydraulic oil flow. And under the normal control, the monitor device 43 displays machine information such as the engine coolant temperature, hydraulic oil temperature and the amount of fuel remaining.

Next, the details of the warm up control regarding controller 16 is explained. When a machine meets the criteria for hydraulic circuit warm up (such as hydraulic oil temperature or outside air temperature meets threshold conditions), controller 16 communicates to the monitor device 43 to display an inquiry screen for the hydraulic circuit warm up operation. If an operator inputs "start warm up" on the monitor device 43 according to the inquiry screen, controller 16 outputs a control signal to the first and the second warm up valves 32 and 33 to switch them to the open position to open the first and the second return lines 30 and 31. And after the first and the second warm up valves 32 and 33 are opened, hydraulic oil from the first and the second hydraulic pumps 1 and 2 can be automatically circulated in the hydraulic circuit so that the hydraulic oil and the control valve unit assembly can be warmed up.

Next, the details of the fault diagnosis control within controller 16 are explained. The fault diagnostic control method 44 has the fault diagnostic execution method 47 and the fault control valve determination method 48, and carries out fault diagnosis started with operation of the monitor device 43, and in this embodiment, the monitor device 43 has a service mode which can be started with a particular key operation, such as a password input, by a particular person such as a service technician from the dealer, and the fault diagnosis control operation can be carried out in the service mode. (in this specification after here, the person carrying out the fault diagnosis control operation is described as the technician)

The memory 46 in controller 16 includes control data for multiple test patterns of the fault diagnosis. The multiple test patterns have various combinations which focus on 2 or more components in the control valve (the first and the second main relief valves 21 and 22, the first and the second bypass valves 25 and 26, the straight travel valve 27 and the merge valve 29) and in this embodiment, as shown in the chart described in FIG. 3, there is test pattern 1 which focuses on the first bypass valve 25, the first main relief valve 21 and the first warm up valve 32 for the fault diagnosis, the test pattern 2 which focuses on the second bypass valve 26, the second main relief valve 22 and the second warm up valve 33 for the fault diagnosis, the test pattern 3 focuses on the first bypass valve 25, the first main relief valve 21, the first warm up valve 32 and the second warm up valve 33 for the fault diagnosis, and the test pattern 4 which focuses on the second bypass valve 26, the second main relief valve 22, the first warm up valve 32 and the second warm up valve 33 for the fault diagnosis. Additionally, in this embodiment, there are more test patterns for pump, test 1 focuses on the first hydraulic pump 1 and test 2 focuses on the second hydraulic pump 2 for the fault diagnosis. In this embodiment, the first bypass valve 25, the second bypass valve 26, the first main relief valve 21, the second relief valve 22, the first warm up valve 32 and the second warm up valve 33 which are included in the test pattern 1, 2, 3 or 4 are control valve components for fault diagnosis (target control valve components for fault diagnosis). Further, the control data of test pattern 1, 2, 3 and 4 are preliminary set in the memory 46 in controller 16 in this embodiment, and the other test patterns which focus on other particular control valve components may be added to the memory 46 by the monitor device 43. However, these pump tests 1 and 2 are not included in the test patterns described in this invention.

To carry out the control valve fault diagnosis, first, the monitor devise 43 is operated to start control valve automatic fault diagnosis. After the start operation, a signal according to the start operation is input to controller 16 and it starts the control valve automatic fault diagnosis with the fault diagnosis method 44 which has the fault diagnostic execution method 47 and the fault control valve determination method 48. In this procedure, as described later, the fault diagnostic execution method 47 outputs a diagnosis control signal, which has been set for each of test pattern, to the control valve components that are being diagnosed by the test, and carries out fault diagnosis based on each of test pattern. And the fault valve determination method 48 specifies fault control valve (hereafter fault control valve is described as fault valve) by checking diagnosis results of control valves included in the test patterns which have been carried out fault diagnosis by the fault diagnostic execution method 47.

When the fault diagnostic execution method 47 starts fault diagnosis of each test pattern, the fault diagnostic execution method 47 outputs a diagnosis control signal, which has been set for each of test pattern, to the control valve components that are being diagnosed by the test, and also, the fault diagnostic execution method 47 controls the first and the second hydraulic pumps 1 and 2, detects the delivery pressure with the first and the second pressure sensors 41 and 42, and the test determines if there is an issue with the control valve components by comparing the measured delivery pressure value with a normal, predetermined delivery pressure value.

When one of the test patterns (1, 2, 3 or 4) is being carried out, all of metering valves in the metering valve units 10, 11, 12, 13, 14 and 15 are controlled to shift to close position, and additionally, it is not illustrated, a swing brake device, which is located in the hydraulic circuit of a hydraulic excavator, is controlled to apply the swing brake.

Next, the detail of the diagnosis control of the fault diagnostic execution method 47 is explained for each of the test patterns 1, 2, 3 and 4. Test pattern 1, which targets the functionality of the first bypass valve 25, the first main relief valve 21 and the first warm up valve 32 for the fault diagnosis, shifts the merge valve 29 to the second position Y which does not allow connection between the first delivery line 17 and the second delivery line 18. The straight travel valve 27 is shifted to the first position X, which will supply pressurized hydraulic oil in the first delivery line 17 to the left travel metering valve unit 12, and also supply pressurized hydraulic oil to the bucket metering valve unit 10 and the boom metering valve unit 11 through the straight travel valve 27, and supply pressurized hydraulic oil in the second delivery line 18 to the swing metering valve unit 14 and the stick metering valve unit 15 and also to the right travel metering valve unit 13 through the straight travel valve 27. The first bypass valve 25 is controlled to close the first bypass line 23, and the second bypass valve 26 is controlled to open the second bypass line 24 with maximum valve opening area. The first and the second warm up valve 32 and 33 are controlled to shift to close position which can close the first and the second return lines 30 and 31.

Figure 4:
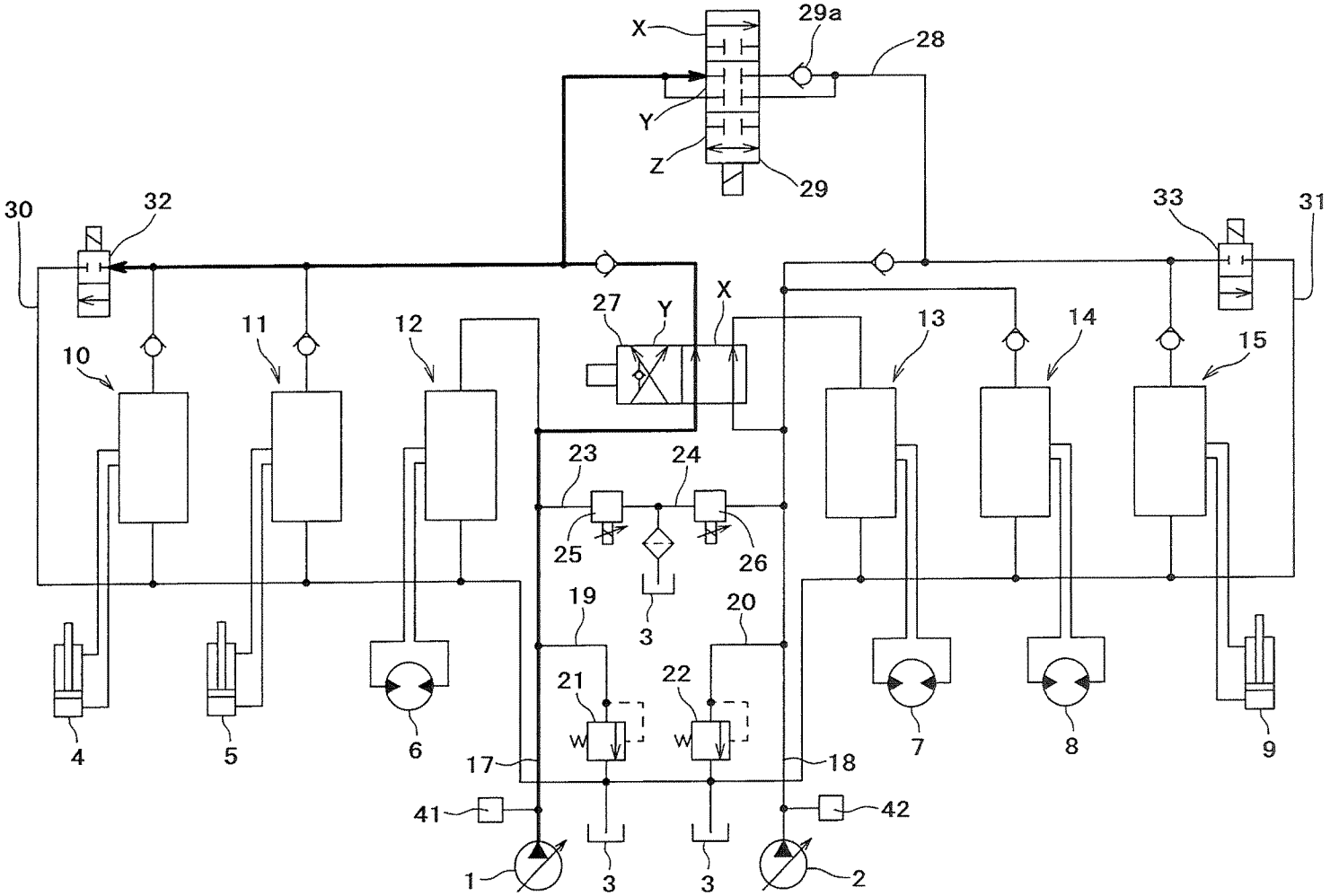
FIG. 4 is a hydraulic circuit diagram showing hydraulic oil flow for test pattern 1.

When the control valve components are in the diagnostic state for test pattern 1, as described above, the fault diagnostic execution method 47 controls the first hydraulic pump 1 to actuate with minimum delivery flow. Under test pattern 1, as shown in the hydraulic circuit diagram in FIG. 4, the hydraulic oil from the first hydraulic pump 1 is supplied to merge valve 29, which is switched to the second position Y through the first delivery line 17 and the straight travel valve 27, and also, supplied to the first warm up valve 32, which is switched to the close position. In this condition, hydraulic pressure of the first delivery line 17 which is measured with the first pressure sensor 41 is compared with the predetermined set pressure specification of the first main relief valve 21 (correspond to the hydraulic pump standard delivery pressure value described in this invention). As the result, if the measured hydraulic pressure of the first delivery line 17 is the same or larger than the predetermined set pressure specification of the first main relief valve 21, then the fault diagnostic execution method 47 concludes test pattern 1 has no fault (all of the control valve components which are targeted in the test pattern 1 have no fault). On the other hand, if the measured pressure of the first delivery line 17 is less than the set pressure of the first main relief valve 21, then the fault control valve determination method 48 determines test pattern 1 has a fault (at least one of the control valve components which are targeted in the test pattern 1 has a fault).

Test pattern 2, which targets the second bypass valve 26, the second main relief valve 22 and the second warm up valve 33 for fault diagnosis, shifts merge valve 29 to the first position, X, which allows hydraulic oil flow from the first delivery line 17 to the second delivery line 18 but does not allow from the second delivery line 18 to the first delivery line 17. The straight travel valve 27 is shifted to the first position, X, which can supply pressurized hydraulic oil in the first delivery line 17 to the left travel metering valve unit 12 and also to the bucket metering valve unit 10 and the boom metering valve unit 11 through the straight travel valve 27, and supply pressurized hydraulic oil in the second delivery line 18 to the swing metering valve unit 14 and the stick metering valve unit 15 and also to the right travel metering valve unit 13 through the straight travel valve 27. The first bypass valve 25 is shifted to the open the first bypass line 23 with maximum valve opening area, and the second bypass valve 26 is shifted to close the second bypass line 24. The first and the second warm up valves 32 and 33 are shifted to the closed position which closes the first and the second return line 30 and 31.

Figure 5:
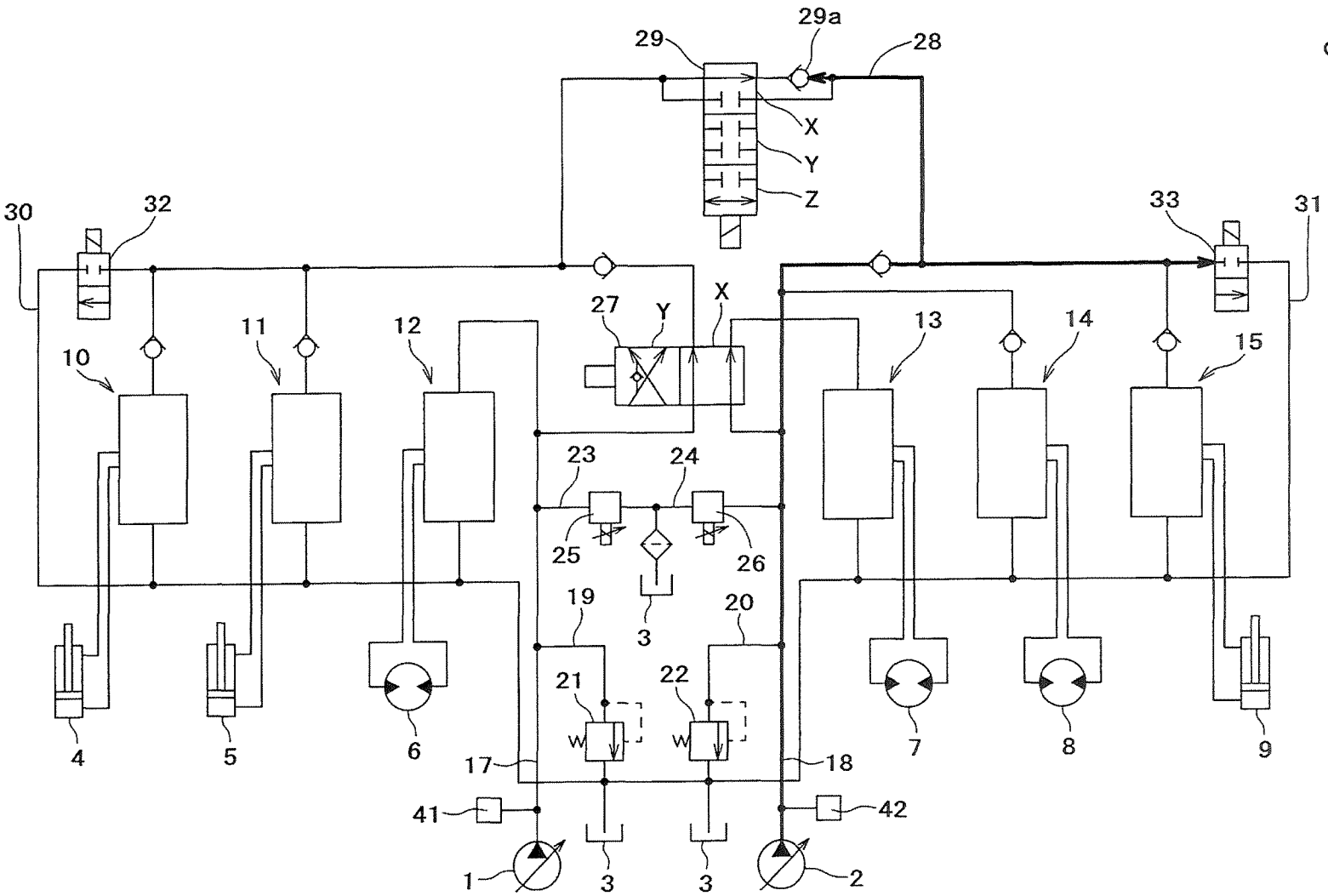
FIG. 5 is a hydraulic circuit diagram showing hydraulic oil flow for test pattern 2.

When the control valve components are in a diagnostic state of test pattern 2, as above described, the fault diagnostic execution method 47 controls the second hydraulic pump 2 to actuate with minimum delivery flow. Under the test pattern 2, as shown in the hydraulic circuit diagram in FIG. 5, the hydraulic oil from the second hydraulic pump 2 is supplied to the merge valve 29, which is switched to the first position X through the second delivery line 18, and also, supplied to the second warm up valve 33 switched to the close position. In this condition, hydraulic pressure of the second delivery line 18 which is measured with the second pressure sensor 42 is compared with the predetermined set pressure specification of the second main relief valve 22 (correspond to the hydraulic pump standard delivery pressure value described in this invention). As a result, if the measured hydraulic pressure of the second delivery line 18 is the same or larger than the predetermined set pressure specification of the second main relief valve 22, then the fault diagnostic execution method 47 concludes test pattern 2 has no fault (all of the control valve components targeted in test pattern 2 have no fault). On the other hand, if the measured pressure of the second delivery line 18 is less than the predetermined set pressure specification of the second main relief valve 22, then the f fault diagnostic execution method 47 determines test pattern 2 has a fault (at least one of the control valve components targeted in the test pattern 2 has a fault).

Test pattern 3, which targets the first bypass valve 25, the first main relief valve 21, the first warm up valve 32 and the second warm up valve 33 for the fault diagnosis, the merge valve 29 is controlled to shift to the third position Z which connects first delivery line 17 and the second delivery line 18 to merge hydraulic oil flows in each of the delivery lines. The straight travel valve 27 is controlled to shift the first position X which can supply pressurized hydraulic oil in the first delivery line 17 to the left travel metering valve unit 12 and also to the bucket metering valve unit 10 and the boom metering valve unit 11, and supply pressurized hydraulic oil in the second delivery line 18 to the swing metering valve unit 14 and the stick metering valve unit 15 and also to the right travel metering valve unit 13 through the straight travel valve 27. The first bypass valve 25 is controlled to close the first bypass line 23, and the second bypass valve 26 is controlled to open the second bypass line 24 with maximum valve opening area. The first and the second warm up valves 32 and 33 are controlled to shift to close position which can close the first and the second return lines 30 and 31.

Figure 6:
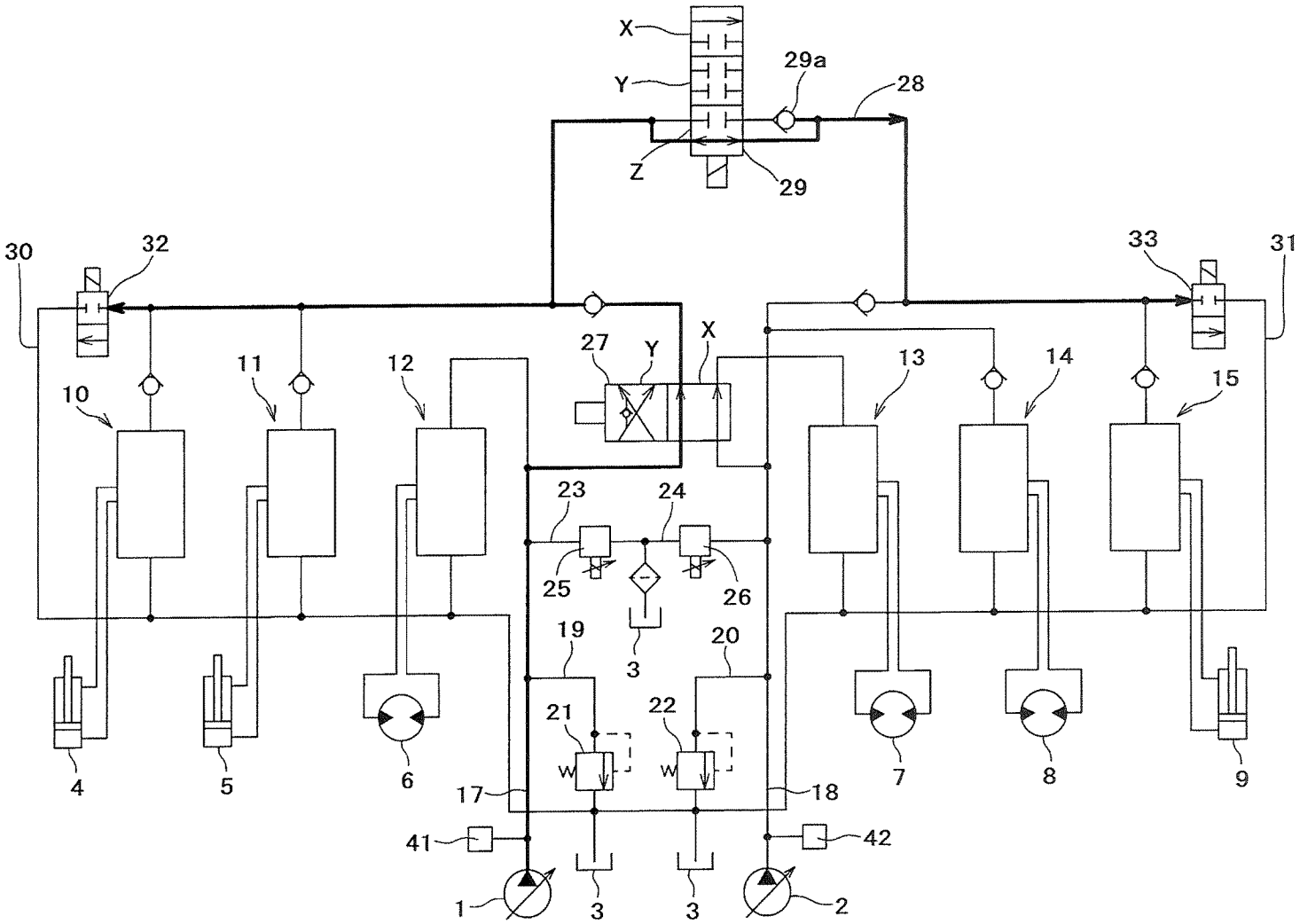
FIG. 6 is a hydraulic circuit diagram showing hydraulic oil flow for test pattern 3.

When the control valve components are to be in a status for diagnosis of the test pattern 3 as above described, the fault diagnostic execution method 47 controls the first hydraulic pump 1 to actuate with minimum delivery flow. Under test pattern 3, as shown in the hydraulic circuit diagram in FIG. 6, the hydraulic oil from the first hydraulic pump 1 is supplied to the first warm up valve 32 switched to the close position through the first delivery line 17 and the straight travel valve 27, and also, supplied to the second warm up valve 33 switched to the close position through the merge valve 29 which is in the third position Z. In this condition, hydraulic pressure of the first delivery line 17 is measured with the first pressure sensor 41 and is compared with the predetermined set pressure specification of the first main relief valve 21 (correspond to the hydraulic pump standard delivery flow value described in this invention). As the result, if the measured hydraulic pressure of the first delivery line 17 is same or larger than the predetermined set pressure specification of the first main relief valve 21, then the fault diagnostic execution method 47 concludes test pattern 3 has no fault (all of the control valve components in test pattern 3 have no fault). On the other hand, if the measured pressure of the first delivery line 17 is less than the predetermined set pressure specification of the first main relief valve 21, then the fault diagnostic execution method 47 determines test pattern 3 has a fault (at least one of the control valve components in test pattern 3 have a fault).

Test pattern 4, which targets the second bypass valve 26, the second main relief valve 22, the first warm up valve 32 and the second warm up valve 33 for fault diagnosis, the merge valve 29 is shifted to the third position Z, which connects first delivery line 17 and the second delivery line 18 to merge hydraulic oil flow from each delivery line. The straight travel valve 27 is shifted to the first position X which supplies pressurized hydraulic oil to the first delivery line 17 to the left travel metering valve unit 12, the bucket metering valve unit 10 and the boom metering valve unit 11, and the straight travel valve 27 simultaneously supplies pressurized hydraulic oil in the second delivery line 18 to the swing metering valve unit 14 and the stick metering valve unit 15 and also to the right travel metering valve unit 13. The first bypass valve 25 is opened to the first bypass line 23 with maximum valve opening area, and the second bypass valve 26 is closed to the second bypass line 24. The first and the second warm up valves 32 and 33 are shifted to the close position which closes the oil path to the first and second return lines 30 and 31.

Figure 7:
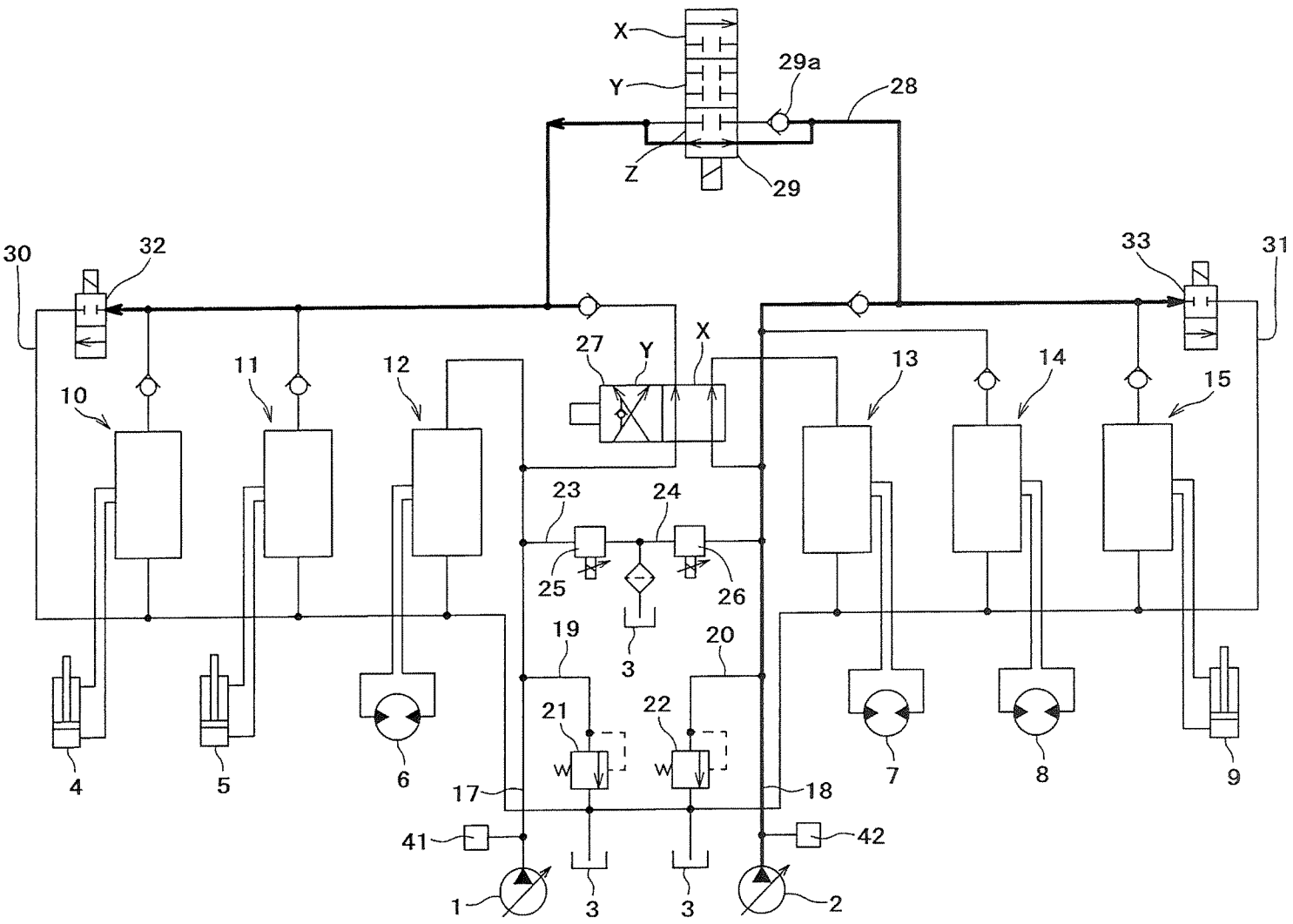
FIG. 7 is a hydraulic circuit diagram showing hydraulic oil flow for test pattern 4.

When the control valve components are in the diagnostic state of test pattern 4 as previously described, the fault diagnostic execution method 47 controls the second hydraulic pump 2 to actuate with minimum delivery flow. Under test pattern 4, as shown in the hydraulic circuit diagram in FIG. 7, the hydraulic oil from the second hydraulic pump 2 is supplied to the second warm up valve 33, which is switched to the close position through the second delivery line 18, and also, supplied to the first warm up valve 32 which is also switched to the close position through the merge valve 29 switched to the third position Z. In this condition, hydraulic pressure of the second delivery line 18 which is measured with the second pressure sensor 42 and is compared with the predetermined set pressure specification of the second main relief valve 22 (corresponding to the hydraulic pump standard delivery pressure value described in this invention. If the measured hydraulic pressure of the second delivery line 18 is same or larger than the predetermined set pressure specification of the second main relief valve 22, then the fault diagnostic execution method 47 determines test pattern 4 has no fault (all of the control valve components in test pattern 4 have no fault). On the other hand, if the measured pressure of the second delivery line 18 is less than the predetermined set pressure specification of the second main relief valve 22, then the fault diagnostic execution method 47 concludes the test pattern 4 has a fault (at least one of the control valve components in test pattern 4 has a fault).

Furthermore, in this embodiment, the fault control valve determination method 48 specifies fault valves using diagnosis results of test pattern 1, 3 and 4, out of the test pattern 1, 2, 3 and 4. And also the fault control valve determination method 48 has installed control programs to make the fault diagnostic execution method 47 carry out fault diagnosis of test pattern 1, 3 and 4, and to determine fault control valves based on the diagnosis results of the test pattern 1, 3 and 4. According to the installed control programs, the fault control valve determination method 48 outputs control commands to the fault diagnostic execution method 47 to start fault diagnosis test pattern 1, 3 and 4 one by one, in predetermined order, and specifies fault valves based on the diagnosis results of each test pattern.

Fault valve specification by the fault valve determination method 48 is carried out with checking diagnosis results of control valves included in the test patterns which have been carried out fault diagnosis. Then the fault valve determination method 48 can determine the faulty control valve components from the result of each test pattern. For more details, if a diagnosis result for one test pattern has a fault and another test pattern diagnosis result has no fault, and one control valve component is included in the fault test pattern but is not included in the no fault test pattern, then the fault valve determination method 48 can determine the control valve component has a fault. And in the event a control valve component is included in multiple fault test patterns, and also the number of such a control valve component is only one or very few, it is specified the control valve component has a higher possibility of fault. Furthermore, the fault valve determination method 48 can not only determine one control valve component which has a fault or higher possibility of fault, but can determine multiple control valve components which include at least one faulty control valve component. And in this embodiment, the control valve components which have higher possibility of fault or are included in at least one faulty control valve component test pattern may be individually diagnosed later.

Figure 8:
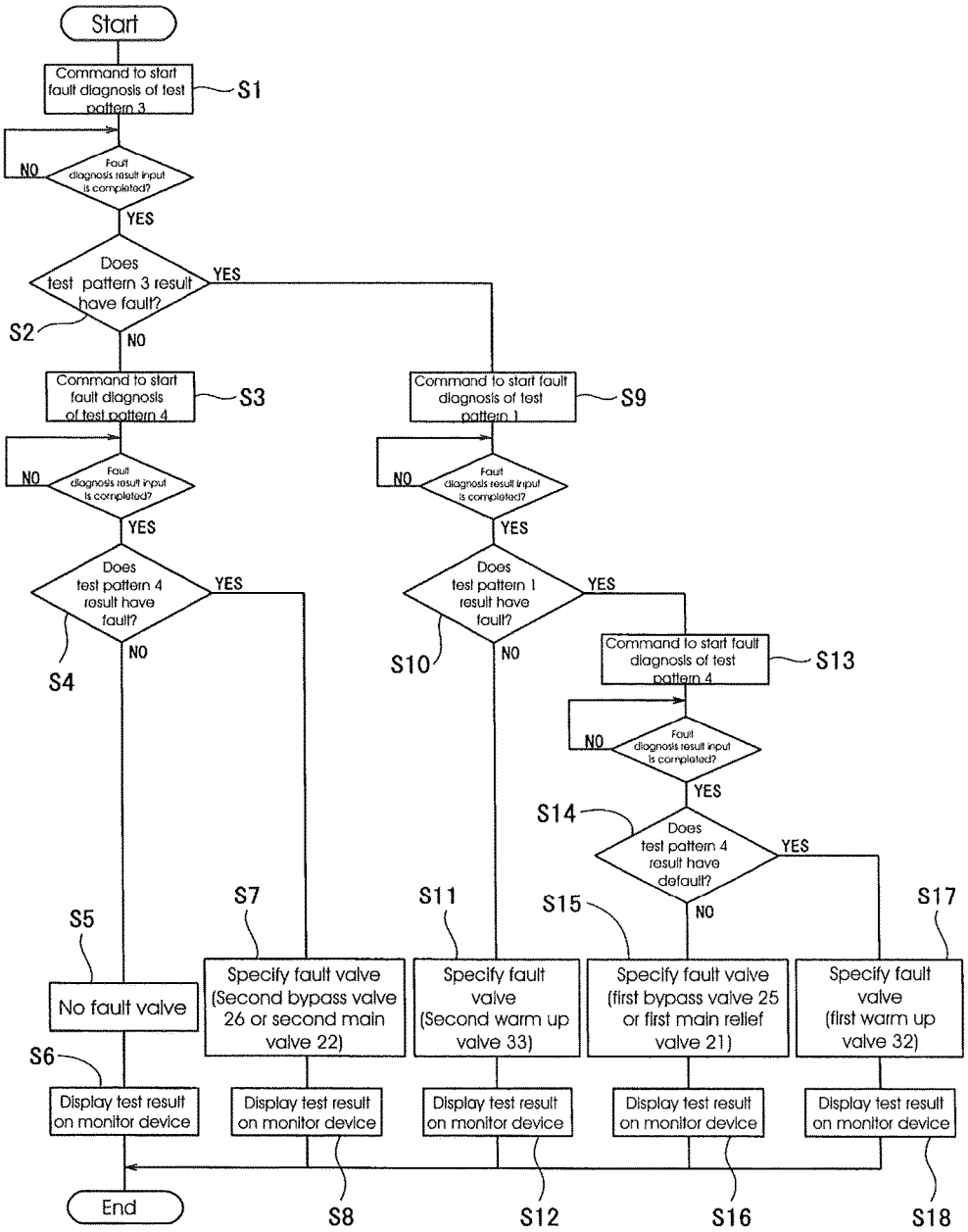
FIG. 8 is a flowchart showing control procedures of automatic control valve fault diagnosis for the 1st practical embodiment.
Figure 9:
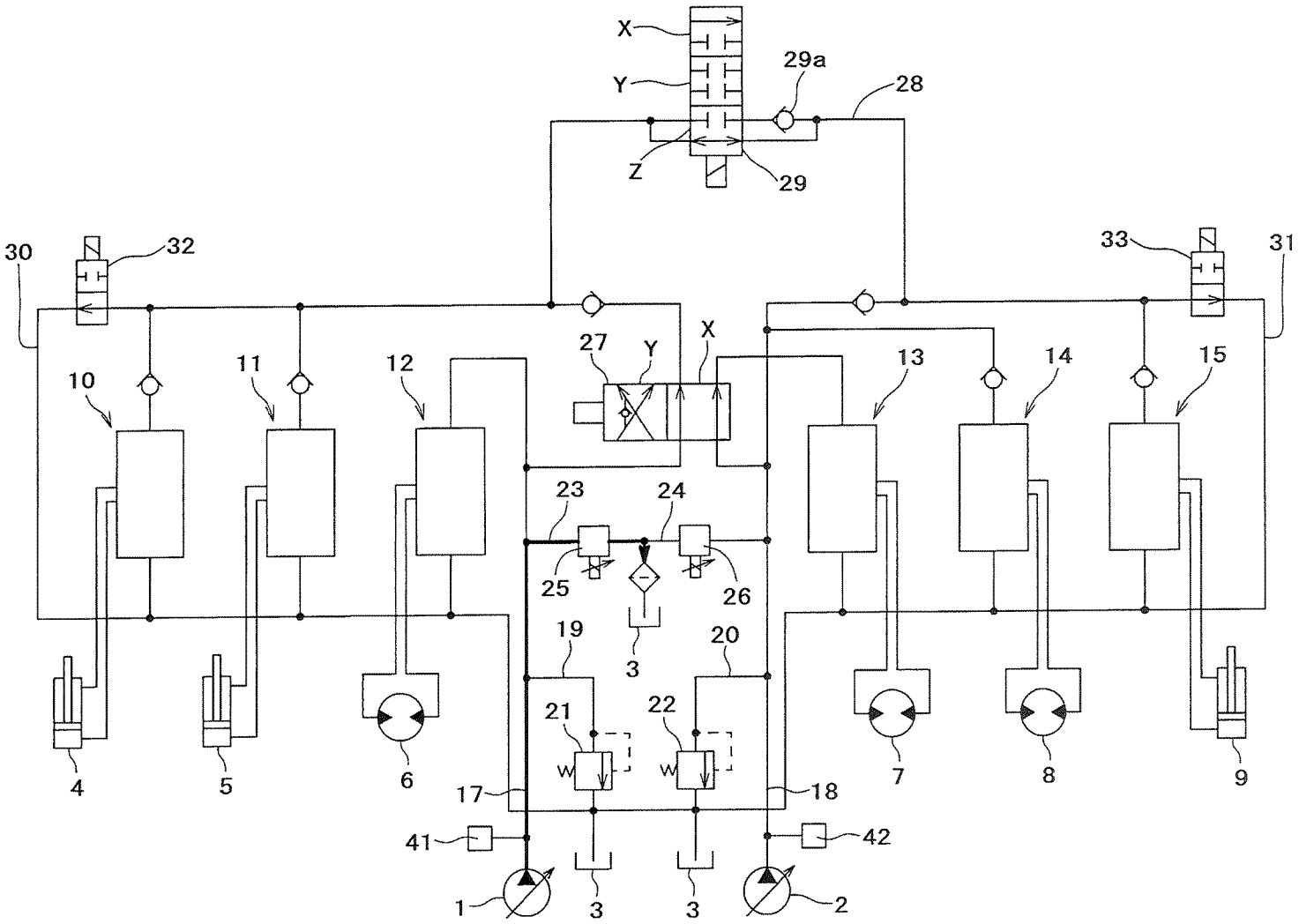
FIG. 9 is a hydraulic circuit diagram showing hydraulic oil flow for pump test 1.

Next, control valve automatic fault diagnosis control procedures which are carried out by the fault valve determination method 48 is explained according to a flowchart described in FIG. 8.

First, when an automatic fault diagnosis is started based on operation of the monitor device 43, the fault valve determination method 48 outputs control command to the fault diagnostic execution method 47 to start fault diagnosis of the test pattern 3 (Step S1). After the fault diagnostic execution method 47 receives the control command, the fault diagnosis of the test pattern 3 is carried out and the diagnosis result is outputted to the fault valve determination method 48.

When the diagnosis result of the test pattern 3 is inputted, the fault valve determination method 48 specifies the diagnosis result is faulty or no fault (Step S2). If it is no fault (NO), then the fault valve determination method 48 outputs control command to the fault diagnostic execution method 47 to start fault diagnosis of the test pattern 4. When the fault diagnostic execution method 47 receives the control command, the fault diagnosis of the test pattern 4 is carried out and the diagnosis result is outputted to the fault valve determination method 48.

When the diagnosis result of the test pattern 4 is inputted, the fault valve determination method 48 specifies the diagnosis result is faulty or no fault (Step S4). If it is no fault (NO), then the fault valve determination method 48 specifies there is no fault valve (fault control valve component) (Step S5), displays the result on the display of the monitor device 43 (Step S6), and terminates the automatic fault diagnosis.

And if, in the step S4, the diagnosis result of the test pattern 4 is faulty (YES), then the fault valve determination method 48 specifies the second bypass valve 26 or the second main relief valve 22 should be fault valve. The result is displayed on the display of the monitor device 43 and terminates the automatic fault diagnosis.

If, in the step S2, the diagnosis result of test pattern 3 is faulty (YES), then the fault valve determination method 48 outputs control command to the fault diagnostic execution method 47 to start fault diagnosis of the test pattern 1 (Step S9). When the fault diagnostic execution method 47 receives the control command, the fault diagnosis of the test pattern 1 is carried out and the diagnosis result is outputted to the fault valve determination method 48.

When the diagnosis result of the test pattern 1 is inputted, the fault valve determination method 48 specifies the diagnosis result is faulty or no fault (Step S10). If it is no fault (NO), then the fault valve determination method 48 specifies the fault valve should be the second warm up valve 33 (Step S11), displays the result on the display of the monitor device 43 (Step S12), and terminates the automatic fault diagnosis.

If, in the step S10, the diagnosis result of test pattern 1 is faulty (YES), then the fault valve determination method 48 outputs control command to the fault diagnostic execution method 47 to start fault diagnosis of the test pattern 4 (Step S13). When the fault diagnostic execution method 47 receives the control command, the fault diagnosis of the test pattern 4 is carried out and the diagnosis result is outputted to the fault valve determination method 48.

When the diagnosis result of the test pattern 4 is inputted, the fault valve determination method 48 specifies the diagnosis result is faulty or no fault (Step S14). If it is no fault (NO), then the fault valve determination method 48 specifies the fault valve should be the first bypass valve 25 or the first main relief valve 21 (Step S15), displays the result on the display of the monitor device 43 (Step S16), and terminates the automatic fault diagnosis.

If, in the step S14, the diagnosis result of test pattern 4 is faulty (YES), then the fault valve determination method 48 specifies the fault valve should be the first warm up valve 32 (Step S17), displays the result on the display of the monitor device 43 (Step S18), and terminates the automatic fault diagnosis.

As described above, fault diagnosis of test patterns are carried out by the fault diagnostic execution method 47 and the fault valve determination method 48 specifies fault valves as the diagnosis results. Then, the fault diagnostic execution method 47 starts fault diagnosis test patterns for fault valve determination (in this embodiment, test pattern 1, 3 and 4 are selected) one by one, in predetermined order, and when each of fault diagnosis test pattern is completed, the fault diagnostic execution method 47 terminates the rest test patterns of fault diagnosis if the fault valve determination method 48 can be specified fault valves based on the fault diagnosis results of completed test patterns. If the fault valve determination method 48 cannot be specified fault valves, then the next test pattern of fault diagnosis is started.

Therefore, explained according to a flowchart described in the FIG. 8, first, the fault diagnosis of test pattern 3 is carried out in the step S1, and then fault valve cannot be specified because there is only one fault diagnosis result of test pattern 3 so that the fault valve determination method 48 cannot check diagnosis results of control valves included in the test patterns. And fault diagnosis of test patterns is continued.

If the fault diagnosis result of the test pattern 3 is no fault, which is carried out in the step S1, then the fault diagnosis of the test pattern 4 is carried out in the step S3. If the fault diagnosis result of the test pattern 4 is no fault, all of the control valve components included in the test pattern 4 and 3 which have been completed with no fault, that is, all of the control valve components included in this embodiment, are specified as no fault. Then the fault diagnosis of the test patterns are terminated with no fault valve (all of the control valve components are normal).

If the fault diagnosis result of the test pattern 4 is faulty, the control valve components which are included in the test pattern 4 diagnosed faulty and are not included in the test pattern 3 diagnosed no fault, are specified the second bypass valve 26 and the second main relief valve 22. Then the fault diagnosis of the test patterns are terminated with at least one of the second bypass valve 26 and the second main relief valve 22 is specified as a fault valve.

If the fault diagnosis result of the test pattern 3 is faulty, which is carried out in the step S1, the fault diagnosis of the test pattern 1 is carried out in the step S9. If the fault diagnosis result of the test pattern 1 is no fault, the control valve component which is included in the test pattern 3 diagnosed faulty and is not included in the test pattern 1 diagnosed no fault, is specified the second warm up valve 33. Then the fault diagnosis of the test patterns are terminated with the second warm up valve 33 is specified as a fault valve.

If the fault diagnosis result of the test pattern 1 is faulty, which is carried out in the step S9, there are lots of control valve components which are included in both of the test pattern 1 and 3 diagnosed faulty so that fault valves cannot be specified, then fault diagnosis of the test patterns continues and the test pattern 4 is carried out in step S13. If the fault diagnosis result of the test pattern 4 is no fault, which is carried out in the step S13, the control valve components which are included in both of the test pattern 1 and 3 diagnosed faulty and also included in the test pattern 4 diagnosed no fault are the first bypass valve 25 and the first main relief valve 21. Then the fault diagnosis of the test patterns are terminated with at least one of the first bypass valve 25 or the first main relief valve 21 is specified as a fault valve.

If the fault diagnosis result of the test pattern 4 is faulty, the control valve component which is included in all of the test pattern 1, 3 and 4 diagnosed faulty is the first warm up valve 32. Then the fault diagnosis of the test patterns are terminated with the first warm up valve 32 is faulty.

Next, the details of fault diagnosis control by the fault diagnosis method 44 are explained for pump tests land 2. When the automatic fault diagnosis is carried out for the first and the second hydraulic pump 1 and 2, first, the monitor devise 43 is operated to start hydraulic pump automatic fault diagnosis. After the start operation, a signal according to the start operation is input to controller 16 and it starts the hydraulic pump automatic fault diagnosis with the fault diagnosis control method 44. In this case, the fault diagnosis control method 44 carries out the pump test 1 and 2 (to be described later), which diagnoses the first and the second hydraulic pump 1 and 2. When the pump tests 1 and 2 are being carried out, as same as the test pattern 1, 2, 3 and 4 described above, all of metering valves in the metering valve units 10, 11, 12, 13, 14 and 15 are controlled to be in the closed position, and a swing brake device is in the brake state to prevent swing movement.

Pump test 1 troubleshoots the first hydraulic pump 1 by shifting merge valve 29 to the third position, Z, which connects first delivery line 17 and the second delivery line 18 to merge hydraulic oil flow from each of delivery line. The straight travel valve 27 is shifted the first position X which can supply pressurized hydraulic oil in the first delivery line 17 to the left travel metering valve unit 12, the bucket metering valve unit 10 and the boom metering valve unit 11, while simultaneously supplying pressurized hydraulic oil in the second delivery line 18 to the swing metering valve unit 14, the stick metering valve unit 15 and the right travel metering valve unit 13. The first bypass valve 25 and the second bypass valve 26 are shifted open so the first and the second bypass lines 23 and 24 are open with maximum valve opening area. The first and the second warm up valves 32 and 33 are controlled to shift to open position which can open the first and the second return lines 30 and 31.

When the control valve components are in a status for the diagnosis of pump test 1 as described above, fault diagnosis control method 44 controls the first hydraulic pump 1 to actuate with minimum delivery flow. Under the pump test 1, as shown in the hydraulic circuit diagram in FIG. 8, the hydraulic oil from the first hydraulic pump 1 is supplied to the hydraulic tank 3 through the first bypass line 23. In this condition, the volume of hydraulic oil in the first delivery line 17 is increased by 10 percent from its minimum oil flow volume. And then the swash plate angle which is measured with the first swash plate angle sensor 40*a* is compared with the swash plate angle control signal value for the first hydraulic pump 1 to understand if the actual swash plate angle of the first hydraulic pump 1 is precisely controlled and corresponds to the control signal value within a specified, predetermined tolerance. The diagnosis result is displayed on the monitor device 43.

Figure 10:
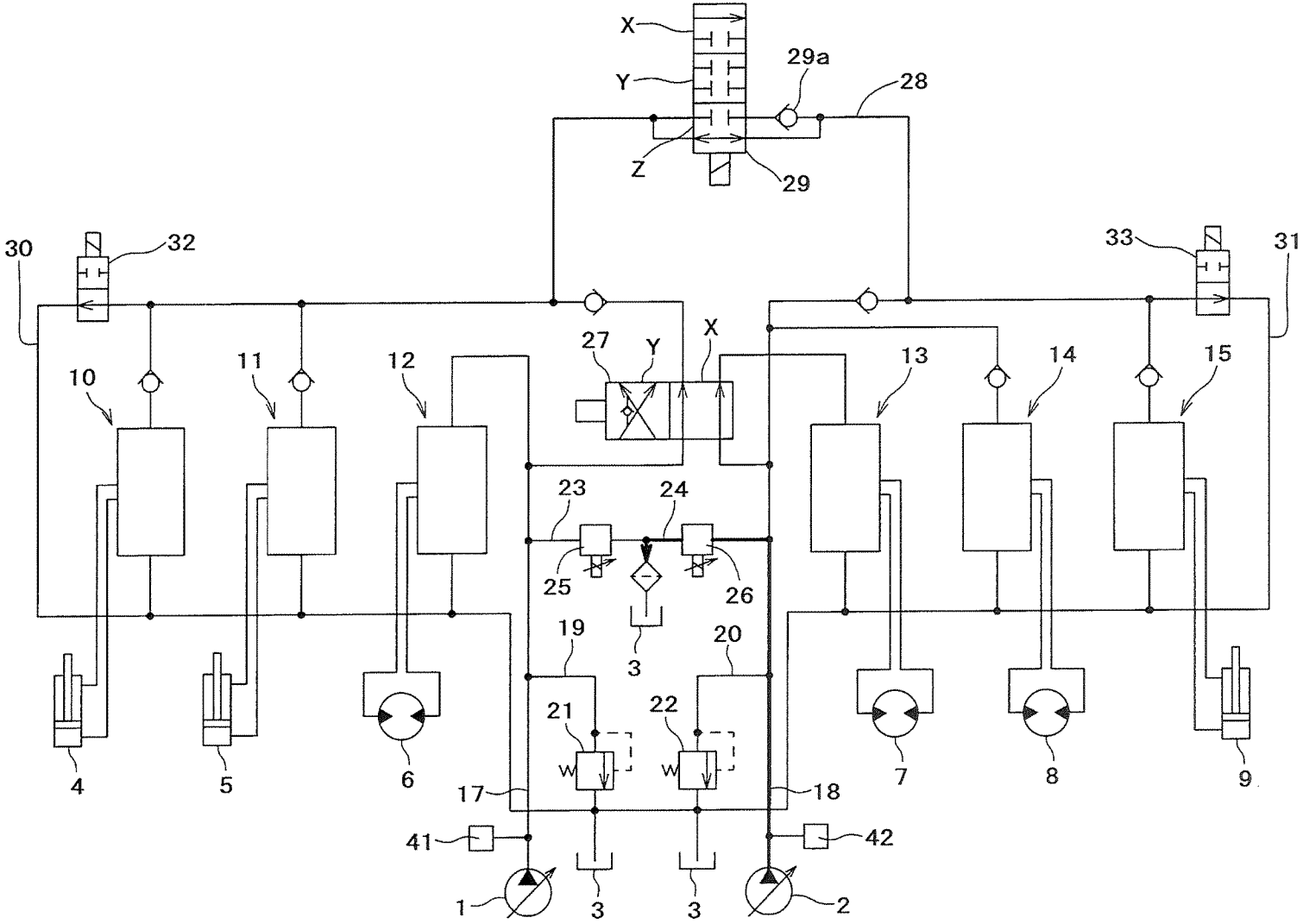
FIG. 10 is a hydraulic circuit diagram showing hydraulic oil flow for pump test 2.

Furthermore, pump test 2 troubleshoots the second hydraulic pump 2 by controlling the merge valve 29, the straight travel valve 27, the first and the second bypass valves 25 and 26, and the first and the second warm up valves 32 and 33 in the fault diagnostic state, which is the same as pump test 1 described above. In this condition, the fault diagnosis control method 44 controls the second hydraulic pump 2 to actuate with minimum delivery flow. Under the pump test 2, as shown in the hydraulic circuit diagram in FIG. 10, the hydraulic oil from the second hydraulic pump 2 is supplied to the hydraulic tank 3 through the second bypass line 24. In this condition, the volume of the hydraulic oil flow to the second delivery line 18 is increased by 10 percent from its minimum oil flow value. And then the swash plate angle which is measured with the second swash plate angle sensor 40*b* is compared with the swash plate angle control signal value for the second hydraulic pump 2 to understand if the actual swash plate angle of the second hydraulic pump 2 is precisely controlled and corresponds to the control signal value within a specified, predetermined tolerance. The diagnosis result is displayed on the monitor device 43.

The first and the second hydraulic pumps 1 and 2 are not included in the diagnosis target with the test patterns in this invention. However, as the embodiment shows, the fault diagnosis control method 44 can also control to carry out the pump test 1 and 2 which are targeted the first and the second hydraulic pump 1 and 2 for the fault diagnosis. As the embodiment shows, the fault diagnosis control method 44 may carry out fault diagnosis tests for hydraulic actuators or valve components, which are not included in the fault diagnosis test patterns described in this invention, in addition to the fault diagnosis test patterns which are targeted the control valve components described in this invention.

As this embodiment describes above, the hydraulic circuit of this hydraulic excavator includes the hydraulic pumps 1 and 2 (the first hydraulic pump 1 and the second hydraulic pump 2 in this embodiment), the hydraulic actuators 4, 5, 6, 7, 8 and 9 which are actuated by hydraulic oil delivered from the hydraulic pump 1 and 2 (the bucket cylinder 4, the boom cylinder 5, the left travel motor 6, the right travel motor 7, the swing motor 8 and the stick cylinder 9 in this embodiment) and multiple control valve components which control hydraulic oil flow direction, volume or hydraulic oil pressure delivered from the hydraulic pumps 1 and 2 (the first and the second main relief valves 21 and 22, the first and the second bypass valves 25 and 26, the straight travel valve 27, the merge valve 29 and the first and the second warm up valves 32 and 33, in this embodiment). To install the fault diagnosis system to diagnose the multiple control valve components into the hydraulic circuit, the fault diagnosis system includes multiple test patterns which have various combinations that troubleshoot 2 or more control valve components out of the multiple valve components (shown in test patterns 1, 2, 3 and 4 in this embodiment), and also includes a fault diagnostic execution method 47 which outputs fault diagnosis control command to control valve components to carry out fault diagnosis for each of the test patterns, and a fault valve determination method 48 which specifies fault control valve by checking diagnosis results of control valve components included in the test patterns which have been carried out fault diagnosis by the fault diagnostic execution method 47.

When the fault diagnosis of the control valve components is carried out, the fault diagnostic execution method 47 carries out fault diagnosis of test patterns and the fault valve determination method 48 specifies fault valves based on the diagnosis results. As the result, fault valves can be easily specified without higher level understanding of the hydraulic circuit configuration, and furthermore, the control valve fault diagnosis time can be considerably shortened and the control valves maintainability and serviceability can be greatly improved. Then, the fault diagnostic execution method 47 carries out fault diagnosis based on the multiple test patterns which have various combinations of 2 or more control valve components, therefore the fault diagnosis time can be in shorter time than a manual fault diagnosis which would remove or test valve components one by one. Furthermore, the fault valve determination method 48 specifies fault valves by checking the control valve components which are included in the test patterns, therefore the control valve component diagnosis control programs can be easily created without understanding of the hydraulic circuit configuration and the diagnosis control is greatly simplified.

Furthermore, the fault diagnostic execution method 47 carries out multiple test patterns to determine fault control valves in order. After each of the test pattern is completed, the fault diagnostic execution method 47 terminates the execution of the rest test patterns if the fault valve determination method 48 can determine fault control valves based on diagnosis results of completed test patterns, and the fault diagnostic execution method continues the rest test patterns if the fault valve determination method 48 cannot determine fault control valves.

Therefore, the fault diagnostic method terminates the execution of the rest test patterns if the fault diagnostic method can determine fault control valves, even if there are lots of test patterns to diagnose lots of control valve components, so numbers of test patterns which should be required for fault diagnosis can be smaller and the control valve fault diagnosis can be carried out in shorter time.

Furthermore, the fault diagnostic execution method 47 and the fault valve determination method 48 are connected to the monitor device 43 which is located in the construction machine's cab. The fault diagnosis of the test patterns and fault valve determination are carried out by the operation of the monitor device 43, and the diagnosis results are displayed on the monitor device 43, therefore the control valve fault diagnosis and diagnosis result display can be carried out with the monitor device 43 located in a cab, without any additional operation device or display tool for fault diagnosis.

Furthermore, in the hydraulic actuators 4, 5, 6, 7, 8 and 9, the metering valve units 10, 11 and 15, which control hydraulic oil flow from/to the bucket cylinder 4, the boom cylinder 5 and the stick cylinder 9, include the first electronic control type meter-in valve 10A, 11A and 15A which control supply oil flow to the rod end cylinder port 4*a*, 5*a* and 9*a* of the hydraulic actuator 4, 5 and 9 (the bucket cylinder 4, the boom cylinder 5 and the stick cylinder 9), the first electronic control type meter-out valve 10B, 11B and 15B which controls disposing oil flow from the rod end cylinder port 4*a*, 5*a* and 9*a* of the hydraulic actuator 4, 5 and 9, the second electronic control type meter-in valve 10C, 11C and 15C which control supply oil flow to the head end cylinder port 4*b*, 5*b* and 9*b* of the hydraulic actuator 4, 5 and 9, and the second electronic control type meter-out valve 10D, 11D and 15D which control disposing oil flow from the head end cylinder port 4*b*, 5*b* and 9*b* of the hydraulic actuator 4, 5 and 9. A hydraulic circuit comprising individual meter-in and meter-out valves to control hydraulic oil flow from/to the hydraulic actuator ports 4*a*, 4*b*, 5*a*, 5*b*, 9*a* and 9*b* is complicated and includes not only the metering valve unit 10, 11 and 15 but lots of the other control valve components to control the hydraulic oil flow direction, the volume or the hydraulic oil pressure. This invention is particularly useful for troubleshooting of hydraulic circuits with lots of control valve components which were previously described, because faulty control valve components can be specified easily and in shorter time.

Figure 11:
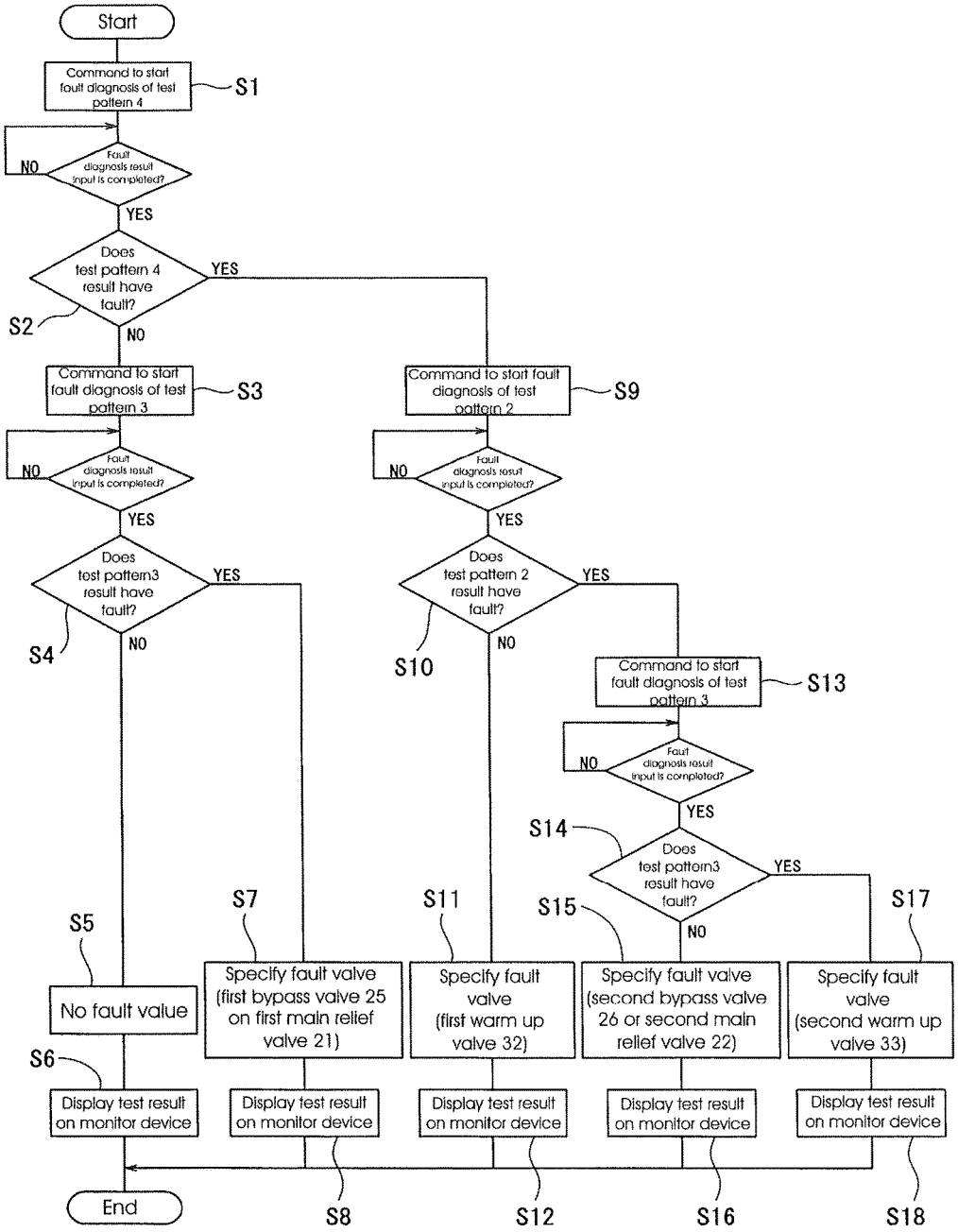
FIG. 11 is a flowchart showing control procedures of automatic control valve fault diagnosis for the second practical embodiment.

While the present invention has been described in detail based on the embodiment (the first embodiment), the present invention is not limited to the above embodiment. For example, in the first embodiment, the fault valve determination is carried out with fault diagnosis results of the test pattern 1, 3 and 4, and also, in the second embodiment described below, the fault valve determination is also carried out with fault diagnosis results of the test pattern 2, 3 and 4. In the second embodiment, control procedures which have been programmed in the fault valve determination method 48, according to the test pattern 2, 3 and 4, are different from those in the first embodiment, however, the system composition and effectiveness of the fault diagnosis control are same as the first embodiment. Therefore only control procedures of automatic fault diagnosis carried out by the fault valve determination method 48 are explained based on a flowchart described on FIG. 11.

In the second embodiment, first, when an automatic fault diagnosis is started based on operation of the monitor device 43, the fault valve determination method 48 outputs control command to the fault diagnostic execution method 47 to start fault diagnosis of the test pattern 4 (Step S1). After the fault diagnostic execution method 47 receives the control command, the fault diagnosis of the test pattern 4 is carried out and the diagnosis result is outputted to the fault valve determination method 48.

When the diagnosis result of the test pattern 4 is inputted, the fault valve determination method 48 specifies the diagnosis result is faulty or no fault (Step S2). If it is no fault (NO), then the fault valve determination method 48 outputs control command to the fault diagnostic execution method 47 to start fault diagnosis of the test pattern 3. When the fault diagnostic execution method 47 receives the control command, the fault diagnosis of the test pattern 3 is carried out and the diagnosis result is outputted to the fault valve determination method 48.

When the diagnosis result of the test pattern 3 is inputted, the fault valve determination method 48 specifies the diagnosis result is faulty or no fault (Step S4). If it is no fault (NO), then the fault valve determination method 48 specifies there is no fault valve (fault control valve component) (Step S5), displays the result on the display of the monitor device 43 (Step S6), and terminates the automatic fault diagnosis.

As the result, if both of the diagnosis result of test pattern 4 and 3 are no fault in step S2 and S4, then all of the control valve components included in the test pattern 4 and 3 which have been completed with no fault, that is, all of the control valve components included in this embodiment, are specified as no fault.

And if, in the step S4, the diagnosis result of the test pattern 3 is faulty (YES), then the fault valve determination method 48 specifies the first bypass valve 25 or the first main relief valve 21 should be fault valve (Step S7). The result is displayed on the display of the monitor device 43 (Step S8) and terminates the automatic fault diagnosis.

As the result, the control valve components which are not included in the test pattern 4 diagnosed no fault in step S2 and which are included in the test pattern 3 diagnosed faulty in step S4, are specified the first bypass valve 25 and the first main relief valve 21. Therefore at least one of the first bypass valve 25 or the first main relief valve 21 is specified as a fault valve.

If, in the step S2, the diagnosis result of test pattern 4 is faulty (YES), then the fault valve determination method 48 outputs control command to the fault diagnostic execution method 47 to start fault diagnosis of the test pattern 2 (Step S9). When the fault diagnostic execution method 47 receives the control command, the fault diagnosis of the test pattern 2 is carried out and the diagnosis result is outputted to the fault valve determination method 48.

When the diagnosis result of the test pattern 2 is inputted, the fault valve determination method 48 specifies the diagnosis result is faulty or no fault (Step S10). If it is no fault (NO), then the fault valve determination method 48 specifies the fault valve should be the first warm up valve 32 (Step S11), displays the result on the display of the monitor device 43 (Step S12), and terminates the automatic fault diagnosis.

As the result, the control valve component which is included in the test pattern 4 diagnosed faulty in step S2 and which is not included in the test pattern 2 diagnosed no fault in step S10 is the first warm up valve 32, therefore the first warm up valve 32 is specified as a fault valve.

If, in the step S10, the diagnosis result of test pattern 2 is faulty (YES), then the fault valve determination method 48 outputs control command to the fault diagnostic execution method 47 to start fault diagnosis of the test pattern 3 (Step S13). When the fault diagnostic execution method 47 receives the control command, the fault diagnosis of the test pattern 3 is carried out and the diagnosis result is outputted to the fault valve determination method 48.

When the diagnosis result of the test pattern 3 is inputted, the fault valve determination method 48 specifies the diagnosis result is faulty or no fault (Step S14). If it is no fault (NO), then the fault valve determination method 48 specifies the fault valve should be the second bypass valve 26 or the second main relief valve 22 (Step S15), displays the result on the display of the monitor device 43 (Step S16), and terminates the automatic fault diagnosis.

As the result, the control valve components which are not included in the test pattern 4 and 2 diagnosed no fault in step S2 and S10, and which are included in the test pattern 3 diagnosed faulty in step S14, are specified the second bypass valve 26 and the second main relief valve 22. Therefore at least one of the second bypass valve 25 or the second main relief valve 22 is specified as a fault valve.

If, in the step S14, the diagnosis result of test pattern 3 is faulty (YES), then the fault valve determination method 48 specifies the fault valve should be the second warm up valve 33 (Step S17), displays the result on the display, of the monitor device 43 (Step S18), and terminates the automatic fault diagnosis.

As the result, the control valve component which is included in all of the test pattern 4, 2 and 3 diagnosed faulty in step S2, S10 and S14 is only the second warm up valve 33, therefore the second warm up valve 33 is specified as a faulty valve.

Furthermore, as the third embodiment described below, this fault diagnosis control can be comprised that first the fault diagnostic execution method 47 carries out all of the test patterns of fault diagnosis, and next the fault valve determination method 48 specifies fault control valves based on the test results of all test patterns. In the third embodiment, explanations for hydraulic circuit including control valves or test patterns are omitted because they are same as described in the first embodiment. And FIGS. 1,2,3,4,5,6 and 7 in the first embodiment can be applicable also in the third embodiment.

Figure 12:
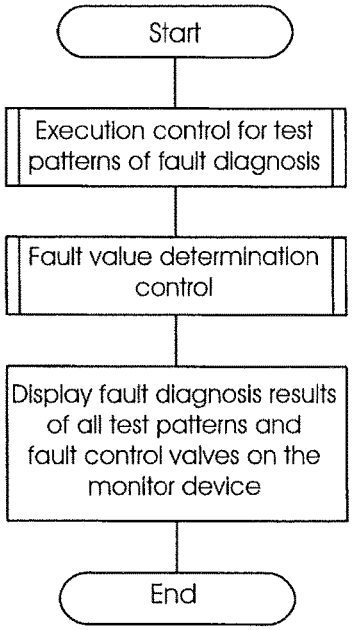
FIG. 12 is a flowchart showing main routine of automatic control valve fault diagnosis for the third practical embodiment.
Figure 13:
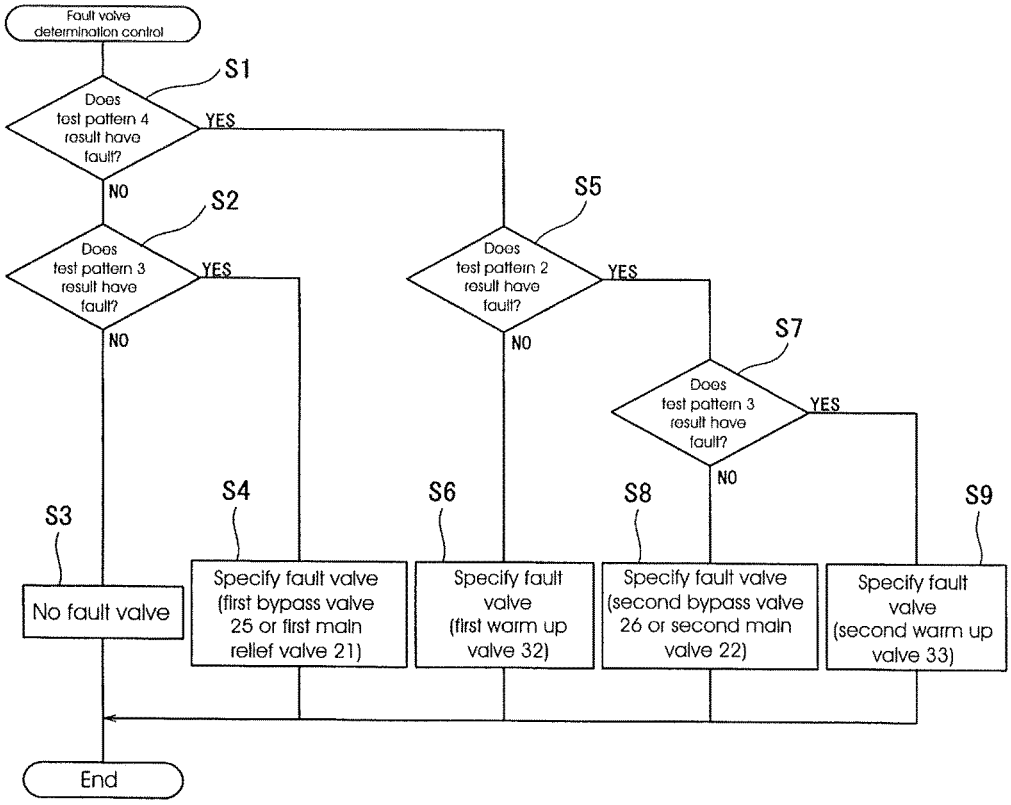
FIG. 13 is a flowchart showing control procedures of fault control valve determination control for the third practical embodiment.

First, control procedures of the fault diagnosis control method in the third embodiment are explained based on flowcharts described on FIG. 12 and FIG. 13.

In the main routine described in a flowchart of FIG. 12, when an automatic fault diagnosis of control valves is started based on operation of the monitor device 43, a signal according to the start operation is input to controller 16 and it starts the control valve automatic fault diagnosis with the fault diagnosis control method 44. In the third embodiment, test pattern 2, 3 and 4 out of the test pattern 1, 2, 3 and 4 are used for fault valve diagnosis and those test pattern 2, 3 and 4 are all for fault valve determination. And fault diagnosis target valves in the third embodiment are the first bypass valve 25, the second bypass valve 25, the first main relief valve 21, the second main relief valve 22, the first warm up valve 32 and the second warm up valve 33.

When the automatic fault diagnosis of control valves is started, the fault diagnosis control method 44 outputs control signals to the fault diagnostic execution method 47, to start test patterns of fault diagnosis control. In the test patterns of fault diagnosis control, the fault diagnostic execution method 47 carries out fault diagnosis of test patterns 2, 3 and 4 in order and output all of the diagnosis results to the fault valve determination method 48. The fault diagnosis of each of test pattern carried out by the fault diagnostic execution method 47 is same as that of in the first embodiment.

When the test patterns of fault diagnosis control is terminated, that is, all of fault diagnosis of test pattern 2, 3 and 4 are completed and the fault diagnosis result is inputted to the fault valve determination method 48, next, the fault diagnosis control method 44 outputs control signals to the fault valve determination method 48, to start fault valve determination control.

In the fault valve determination control, the fault valve determination method 48 specifies fault control valves by checking diagnosis results of control valves included in the test pattern 2, 3 and 4. The fault control valve determination procedure is programmed in the fault valve determination method 48 and the fault valve determination is carried out based on the program. The control procedures of the fault valve determination method 48 in the fault valve determination control are explained later.

When the fault valve determination control is terminated, that is, the fault valve determination method 48 specifies fault control valves, the fault diagnosis control method displays diagnosis results of all of the test pattern 2, 3 and 4 which have been carried out by the fault diagnostic execution method 47, and the fault control valves specified by the fault valve determination method 48, and terminate automatic fault diagnosis of the control valves.

Next, control procedures of the fault valve determination method 48 in the fault valve determination control are explained based on a flowchart described in FIG. 13.

First, when the fault valve determination control is started, the fault valve determination method 48 specifies the diagnosis result of test pattern 4 is faulty or no fault (Step S1). If the test pattern 4 is no fault (NO), next the fault valve determination method 48 specifies the diagnosis result of test pattern 3 is faulty or no fault (Step S2). If the test pattern 3 is no fault (NO), the fault valve determination method 48 specifies there is no fault valve (fault control valve component) (Step S3) and terminates the fault valve determination control.

As the result, if both of diagnosis results of test pattern 4 and 3 in step S1 and S2 are no faults, then all of the control valve components included in the test pattern 4 and 3, that is, all of the fault diagnosis target control valve components in this embodiment are specified as no faults.

If, in the step S2, the diagnosis result of test pattern 4 is faulty (YES), then the fault valve determination method 48 specifies the fault valve should be the first bypass valve 25 or the first main relief valve 21 (Step S4) and terminates the fault valve determination control. As the result, the control valve components which are not included in the test pattern 4 diagnosed no fault in step S1 and which are included in the test pattern 3 diagnosed faulty in step S2 are the first bypass valve 25 and the first main relief valve 21, therefore at least one of the first bypass valve 25 or the first main relief valve 21 is specified as a fault valve.

If, in the step S1, the diagnosis result of test pattern 4 is faulty (YES), next the fault valve determination method 48 specifies the diagnosis result of test pattern 2 is faulty or no fault (Step S5). If the test pattern 2 is no fault (NO), the fault valve determination method 48 specifies the fault valve should be the first warm up valve 32 (Step S6) and terminates the fault valve determination control. As the result, the control valve components which are included in the test pattern 4 diagnosed faulty in step S1 and which are not included in the test pattern 2 diagnosed no fault in step S5 is the first warm up valve 32, therefore the first warm up valve 32 is specified as a fault valve.

If, in the step S5, the diagnosis result of test pattern 2 is faulty (YES), next the fault valve determination method 48 specifies the diagnosis result of test pattern 3 is faulty or no fault (Step S7). If the test pattern 3 is no fault (NO), the fault valve determination method 48 specifies the fault valve should be the second bypass valve 26 or the second main relief valve 22 (Step S8) and terminates the fault valve determination control.

As the result, the control valve components which are not included in the test pattern 4 and 2 diagnosed no fault in step S1 and step S5 and which are included in the test pattern 3 diagnosed faulty in step S7 are the second bypass valve 26 and the second main relief valve 22, therefore at least one of the second bypass valve 26 or the second main relief valve 22 is specified as a fault valve.

If, in the step S7, the diagnosis result of test pattern 3 is faulty (YES), the fault valve determination method 48 specifies the fault valve should be the second warm up valve 33 (Step S9) and terminates the fault valve determination control.

As the result, the control valve component which is included in the test pattern of 4, 2 and 3 diagnosed faulty in step S1, S5 and S7 is only the second warm up valve 33, therefore the second warm up valve 33 is specified as a faulty valve.

In the third embodiment, first the fault diagnostic execution method 47 carries out all of the test patterns of fault diagnosis, and next the fault valve determination method 48 specifies fault control valves based on the test results of all test patterns.

In the third embodiment, as same as the first embodiment, the fault diagnostic execution method 47 carries out fault diagnosis based on the multiple test patterns which have various combinations of 2 or more control valve components, therefore the fault diagnosis time can be in shorter time than a manual fault diagnosis which would remove or test valve components one by one. Furthermore, the fault valve determination method 48 specifies fault valves by checking the control valve components which are included in the test patterns, therefore the control valve component diagnosis control programs can be easily created without understanding of the hydraulic circuit configuration and the diagnosis control is greatly simplified.

Furthermore, in the third embodiment, first the fault diagnostic execution method 47 carries out all of the test patterns of fault diagnosis, and next the fault valve determination method 48 specifies fault control valves based on the test results of all test patterns. Therefore the fault diagnosis control program can be more simple and easier to be updated to add new test patterns. Additionally, all of the fault diagnosis test patterns are carried out so that in case fault control valves are not specified by fault valve determination with the fault valve determination method 48 (for example, multiple control valve components are simultaneously fault), the service technician can confirm all of diagnosis results of the test patterns and carry out further investigation based on the diagnosis result, such as individual fault diagnosis for a particular control valve component.

In the third embodiment, the fault valve determination is carried out with fault diagnosis results of the test pattern 1, 3 and 4, and also, the fault valve determination is also carried out with fault diagnosis results of the test pattern 2, 3 and 4.

Furthermore, test patterns of the present invention are not limited to the test patterns 1, 2, 3 and 4 described in the embodiments. Additional test patterns beyond test patterns 1, 2, 3 and 4 can be set as necessary in accordance to various construction machine hydraulic circuits or control valve components in the hydraulic circuits. In the first, second and third embodiments described above, each of the fault diagnosis test patterns does not include metering valves to control hydraulic oil flow from/to the hydraulic actuator, however, the test pattern may include the metering valves as the control valve. And in these embodiments described above, as the fault diagnosis procedure, first fault diagnosis is carried out with the fault diagnosis test patterns for the control valves except the metering valve units, and if the fault diagnosis results with the control valve components having no fault, then another fault diagnosis for the metering valve units will be carried out.

INDUSTRIAL APPLICABILITY

The present invention has industrial applicability to carry out fault diagnosis for the control valve components in a hydraulic circuit of a working machine such as a construction machine.

The invention claimed is:

1. A control valve fault diagnostic system which is installed into a working machine to diagnose multiple control valve components, comprising:

hydraulic pumps;

hydraulic actuators which are actuated by hydraulic oil delivered from the hydraulic pumps;

hydraulic control valves having multiple control valve components which control hydraulic oil flow to and from the hydraulic actuators of oil delivered from the hydraulic pumps;

wherein at least one said hydraulic actuator has a pair of hydraulic ports for the hydraulic oil inlet and outlet; and the control valve components of at least one said hydraulic control valve to control hydraulic oil flow from/to the hydraulic actuators including:

a first electronically controlled meter-in valve to control supply oil flow to a first hydraulic actuator port;

a first electronically controlled meter-out valve to control disposing oil flow from the first hydraulic actuator port;

a second electronically controlled meter-in valve to control supply oil flow to the other hydraulic actuator port; and a second electronically controlled meter-out valve to control disposing oil flow from the other hydraulic actuator port;

a memory unit storing multiple test patterns which have various combinations of hydraulic control valve components which target at least two control valve components out of the multiple valve components; and a controller having:

a fault diagnostic execution method which outputs control signals for each of the test patterns to control corresponding valve components to carry out a fault diagnosis operation; and a fault control valve determination method which specifies fault control valves by checking the control valve components which are included in the test patterns diagnosed by the fault diagnostic execution method.

2. A control valve fault diagnosis system according to claim 1, wherein during the fault diagnostic execution method the controller carries out multiple test patterns in sequence to determine fault control valves, and after each test pattern is completed, terminates the execution of any remaining test patterns whenever the fault diagnostic method can determine fault control valves based on the diagnosis result of completed test patterns.

3. A control valve fault diagnosis system according to claim 1, wherein during the fault control valve determination method the controller specifies fault control valves after all of test patterns are carried out by the fault diagnostic execution method, based on the diagnosis results of all test patterns.

4. A control valve fault diagnosis system according to claim 1, further comprising:

a monitor device which is located in a cab of the working machine, and the fault diagnosis using the test patterns and determination of fault control valves are started by the operation of the monitor device, and a diagnosis result is displayed on the monitor device.

5. A control valve fault diagnosis system according to claim 1, further comprising hydraulic pressure sensors to detect a delivery pressure of the hydraulic pumps, wherein the controller in the fault diagnostic execution method carries out fault diagnosis for each of the test patterns, based on a measured hydraulic delivery pressure of the hydraulic pumps.

6. A control valve fault diagnosis system according to claim 5, wherein the controller puts the control valve components in a diagnostic state by outputting a control signal to the control valve components which are targeted according to each test pattern, and carries out a fault diagnosis by comparing measured hydraulic pump delivery pressure value when the control valve components are in the diagnostic state with a hydraulic pump predetermined standard delivery pressure specification value stored in the memory.

* * * * *